US008752619B2

(12) United States Patent
Mulder et al.

(10) Patent No.: US 8,752,619 B2
(45) Date of Patent: Jun. 17, 2014

(54) APPARATUS FOR SUSPENDING A DOWNHOLE WELL STRING

(75) Inventors: Rene Mulder, Etten-Leur (NL); Anton Krijnen, Klundert (NL); Niels De Keijzer, Etten-Leur (NL); Richard Verhoef, Akkrum (NL)

(73) Assignee: National Oilwell Varco, L.P., Houston, TX (US)

( * ) Notice: Subject to any disclaimer, the term of this patent is extended or adjusted under 35 U.S.C. 154(b) by 498 days.

(21) Appl. No.: 13/092,080

(22) Filed: Apr. 21, 2011

(65) Prior Publication Data

US 2011/0259576 A1 Oct. 27, 2011

Related U.S. Application Data

(60) Provisional application No. 61/326,442, filed on Apr. 21, 2010.

(51) Int. Cl.
*E21B 19/086* (2006.01)
*E21B 19/22* (2006.01)

(52) U.S. Cl.
USPC ..... 166/77.51; 81/57.16; 81/57.19; 81/57.21

(58) Field of Classification Search
USPC ..... 166/77.51; 81/57.15, 57.16, 57.19, 81/57.21
See application file for complete search history.

(56) References Cited

U.S. PATENT DOCUMENTS 1,834,316 A 12/1931 McLagan
2,589,159 A 3/1952 Stone
2,962,919 A 12/1960 Grundmann et al.
3,247,742 A 4/1966 Woodbury
3,272,038 A 9/1966 Burstall
3,592,014 A 7/1971 Brown et al.
3,847,040 A 11/1974 Bufkin
4,030,542 A * 6/1977 Poe et al. ..... 166/77.51
4,372,026 A 2/1983 Mosing
4,402,239 A * 9/1983 Mooney ..... 81/57.16
4,475,607 A 10/1984 Haney
4,487,092 A 12/1984 Neves (Continued)

FOREIGN PATENT DOCUMENTS

DE 3829909 A1 3/1989
EP 0311455 A1 4/1989

(Continued)

OTHER PUBLICATIONS

PCT/US2011/033502 International Search Report and Written Opinion, Oct. 7, 2011 (8 p.).

(Continued)

*Primary Examiner* — Giovanna Wright
(74) *Attorney, Agent, or Firm* — Conley Rose, P.C.

(57) ABSTRACT

A clamping device for supporting a well string in a borehole includes a base plate with a central opening and primary clamp body clamp body supported for linear motion relative to the base plate. The clamping device further includes other clamp bodies supported for independent linear motion relative to the base plate. In certain embodiments, the clamping bodies are supported for pivoting motion to open and close the central opening. Each of the clamp bodies carries a gripping member on a face thereof for engaging a well string component received in the central opening. A drive mechanism is coupled to the clamp bodies and configured to move the clamp bodies relative to the base plate.

32 Claims, 23 Drawing Sheets

(56) References Cited

U.S. PATENT DOCUMENTS

| | | | | |
|---|---|---|---|---|
| 4,648,292 | A | 3/1987 | Haynes et al. | |
| 4,649,777 | A | 3/1987 | Buck | |
| 4,836,064 | A | 6/1989 | Slator | |
| 4,869,137 | A | 9/1989 | Slator | |
| 5,161,439 | A | 11/1992 | Wesch, Jr. | |
| 5,172,613 | A | 12/1992 | Wesch, Jr. | |
| 5,193,397 | A | 3/1993 | Hugelier et al. | |
| 5,271,298 | A | 12/1993 | Gazel-Anthoine | |
| 5,394,774 | A | 3/1995 | Dlask | |
| 5,451,084 | A | 9/1995 | Jansch | |
| 5,537,900 | A | 7/1996 | Schaar | |
| 5,609,226 | A | 3/1997 | Penisson | |
| 5,819,605 | A | 10/1998 | Buck et al. | |
| 5,845,549 | A | 12/1998 | Bouligny | |
| 5,853,199 | A | 12/1998 | Wilson | |
| 5,868,045 | A | 2/1999 | Hauk | |
| 5,971,086 | A | 10/1999 | Bee et al. | |
| 6,070,500 | A | 6/2000 | Dlask et al. | |
| 6,079,509 | A | 6/2000 | Bee et al. | |
| 6,264,395 | B1 | 7/2001 | Allamon et al. | |
| 6,302,410 | B1 | 10/2001 | Wentworth et al. | |
| 6,745,646 | B1 | 6/2004 | Pietras et al. | |
| 6,971,283 | B2 * | 12/2005 | Belik | 81/57.33 |
| 7,090,035 | B2 | 8/2006 | Lesko | |
| 7,132,127 | B2 | 11/2006 | Belik | |
| 7,188,547 | B1 | 3/2007 | West et al. | |
| 7,600,450 | B2 | 10/2009 | Montgomery et al. | |
| 2002/0108748 | A1 | 8/2002 | Keyes | |
| 2007/0068669 | A1 | 3/2007 | Lesko | |
| 2008/0174131 | A1 | 7/2008 | Bouligny et al. | |
| 2009/0211404 | A1 | 8/2009 | Pedersen et al. | |

FOREIGN PATENT DOCUMENTS

| | | | |
|---|---|---|---|
| GB | 1452524 | A | 10/1976 |
| GB | 2100639 | A | 1/1983 |
| JP | 11210374 | A | 8/1999 |
| WO | 91/08866 | A1 | 6/1991 |
| WO | 03/102350 | A2 | 12/2003 |
| WO | 2008107712 | A1 | 9/2008 |

OTHER PUBLICATIONS

Great Britain Search Report dated Dec. 16, 2003; Application No. GB 0321346.9 (2 p.).

U.S. Office Action dated Jul. 28, 2005; U.S. Appl. No. 10/661,800 (4 p.).

U.S. Office Action dated Dec. 19, 2005; U.S. Appl. No. 10/661,800 (16 p.).

U.S. Office Action dated Jun. 5, 2006; U.S. Appl. No. 10/661,800 (9 p.).

U.S. Office Action dated Nov. 3, 2006; U.S. Appl. No. 10/661,800 (3 p,).

U.S. Office Action dated Mar. 7, 2007; U.S. Appl. No. 10/661,800 (8 p.).

U.S. Office Action dated Sep. 14, 2007; U.S. Appl. No. 10/661,800 (6 p.).

U.S. Office Action dated Dec. 26, 2007; U.S. Appl. No. 10/661,800 (6 p.).

Great Britain Search Report dated Dec. 16, 2003; Application No. GB 0321345.1 (1 p.).

PCT/US2008/079283 International Search Report and Written Opinion dated Apr. 30, 2009 (11 p.).

* cited by examiner

APPARATUS FOR SUSPENDING A DOWNHOLE WELL STRING

CROSS-REFERENCE TO RELATED APPLICATIONS

This application claims benefit of U.S. provisional patent application Ser. No. 61/326,442 filed Apr. 21, 2010, and entitled "APPARATUS FOR SUSPENDING A DOWNHOLE STRING," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to well drilling, investigation, and maintenance. More particularly, the invention relates to a clamping device and methods for adding components (e.g. drill pipe, stabilizers, other bottom hole components) to, and removing them from, a downhole well string. Still more particularly, the present invention relates to gripping and suspending well string components from above a borehole.

2. Background of the Technology

Drilling for hydrocarbons is an example of an operation involving use of a downhole well string in a borehole formed in the earth. In the case of drilling, the downhole string is referred to as a drill string. Other types of downhole strings are known in the oil and gas industry, e.g., completion string for completion jobs and production string for production jobs. Drilling involves inserting a drill string into a borehole and operating the drill string to drill the borehole. The borehole is typically drilled using a top drive or a rotary table arranged above the borehole to engage the top of the drill string and to rotate it. As the drill string is rotated, a drill bit at the bottom of the drill string cuts into the earth.

During drilling operations, it is necessary from time to time to add or remove lengths of drill pipe ("joints") to/from the drill string. One reason for adding joints is to lengthen the drill string to enable it to drill deeper into the earth. One reason for removing joints from the drill string is to retrieve the drill string from the borehole so that the drill bit can be changed or so other changes can be made to the bottom-hole assembly that is appended to the bottom of the drill string.

Joints can be added to or removed from the drill string in the form of stands, where each stand is made up of multiple connected joints. While a joint, stand or other component is being added to or removed from the drill string, the entire weight of the drill string must be suspended from a position above the borehole. Conventionally, a suspension assembly arranged in the rotary table is used to suspend the drill string and includes components such as bushings, insert bowls, and slips. Typically, a bushing is mounted in an opening in the rotary table. The bushing has an opening which receives the drill string. Slips are inserted between the bushing and the component of the drill string that is adjacent to the bushing. Slips are wedges and may have gripping surfaces, e.g., teeth, for gripping the drill string component. The slips rest on a tapered seat provided by the bushing. In some cases, the slips will not completely bridge the gap between the bushing and the drill string, and so an insert bowl is inserted between the bushing and the drill string to enable the slips to engage the drill string component. Due to their wedged shape, the slips exert a radial clamping force on the suspended string. The clamping force is dependent on the weight of the suspended string, such that as more joints are added to the string, the weight and the clamping force increase. This effect can result in excessive clamping force and can limit the length of string that can be suspended without crushing the component that is directly held by the slip.

Bottom-hole assemblies appended to the bottoms of drill strings are usually made up of many tools or components. Examples of such components include the drill bit, drill collars, shock subs, jars, mud motors, measurement-while-drilling tools, stabilizers and others. These components have different diameters such that, to suspend the bottom hole assembly ("BHA"), many different configurations of the suspension assembly are required in the rotary table. During a single run of a BHA into a borehole, slips, bushings, insert bowls and other components of the suspension assembly may have to be removed and replaced multiple times in order to accommodate the different diameters of the BHA components. These multiple removals and replacements usually require manual handling of heavy components with lifting slings, which is a time consuming and labor intensive operation where procedures aimed at personnel safety must be consistently followed. Further, contemporary rig usage cost is on the order of many thousands of dollars per hour, thus time consuming operations are to be avoided wherever possible. Accordingly, there remains a need in the art for improved methods of efficiently and safely grasping and suspending well strings in a borehole.

BRIEF SUMMARY OF THE DISCLOSURE

Accordingly, there is disclosed herein an apparatus for suspending a well string along a generally vertical axis, such as along the axis of a well bore. In some embodiments, the apparatus includes a base plate having an opening for receiving a well string component, a clamp mechanism supported from the base plate and having a plurality of clamp bodies supported for linear motion relative to the base plate and having gripping surfaces for engaging the well string. The apparatus further includes a drive mechanism for moving the clamp bodies and bringing their gripping surfaces into engagement with the well string. At least one of the clamp bodies is adapted to move between a first position in which it blocks the opening from receiving the well string component, and a second position in which it does not block the opening.

In certain embodiments, the suspending apparatus is adapted to support the weight of the entire well string when, in a first operational mode, the clamp bodies are engaging the well string. Likewise, in certain embodiments, the apparatus includes an adapter member that is coupled to the base plate and is configured for coupling the base plate to an external structure, such as a drilling rig floor, and for transferring the weight of the well string from the clamp mechanism to that external structure.

In some embodiments, the clamp bodies include gripping members that are self adjusting to the size of the well string component. The clamp bodies may, in certain embodiments, include at least one receiving recess having a concave surface, and include a carrier member having a convex surface disposed in the receiving recess with the convex surface of the carrier facing the concave surface of the receiving recess. In such embodiments, the carrier member may also have at least one receiving recess with a concave surface that receives a gripping insert that has a convex surface facing the concave surface of the carrier member.

Also disclosed are certain embodiments in which a suspending apparatus includes a plurality of bellows that are coupled to the base plate and configured to provide a visual indication of the operational mode of the apparatus, the bellows expanding in a mode where the clamping mechanism is not supporting the weight of the well string, and contracting in a mode where the clamping mechanism is supporting the weight of the well string.

In some of the disclosed embodiments, the clamp mechanism includes a primary clamp body supported for linear motion relative to the base plate, and a pair of auxiliary clamp bodies supported for independent linear and for circular motions relative to the base plate. The auxiliary clamp bodies may be pivotable so as to swing into a first position blocking the opening, and to swing from the first position to second positions in which they do not block the opening. When in the first position, the auxiliary clamp bodies may be pinned together to secure them in the first position, the pin being removable so as to allow the auxiliary clamp bodies to move to the second position.

In some embodiments, the drive mechanism includes at least a pair of cylinder assemblies, each of the pair having a first end pivotably connected to the base plate, and a second end configured to releasably engage a clamp body that blocks the base plate opening when the clamping bodies are in a first mode of operation. The cylinders, in certain embodiments, are configured such that their second ends swing away from the base plate opening in at least the first mode of operation.

In embodiments that include a primary clamp body and a pair of auxiliary clamp bodies, the drive mechanism may include a pair of spindles, wherein the first and second auxiliary clamp bodies are rotatably attached to leading ends of the spindles, and wherein the primary clamp body is slidably supported on the trailing ends of the spindles. In certain such embodiments, the drive mechanism may further include a pair of drive motors and a gear arrangement for transferring rotary motion of the drive motors to linear translation of the spindles. Likewise, in such embodiments, the drive mechanism may further include a pair of cylinders coupled to the first and second auxiliary clamp bodies and operable to independently impart the linear and circular motions to the first and second auxiliary clamp bodies.

Thus, embodiments described herein comprise a combination of features and advantages intended to address various shortcomings associated with certain prior devices, systems, and methods. The various features described above, as well as others, will be readily apparent to those skilled in the art upon reading the following detailed description, and by referring to the accompanying drawings.

BRIEF DESCRIPTION OF THE DRAWINGS

The following is a description of the figures in the accompanying drawings.

DETAILED DESCRIPTION OF THE DISCLOSED EMBODIMENTS

Figure 1:
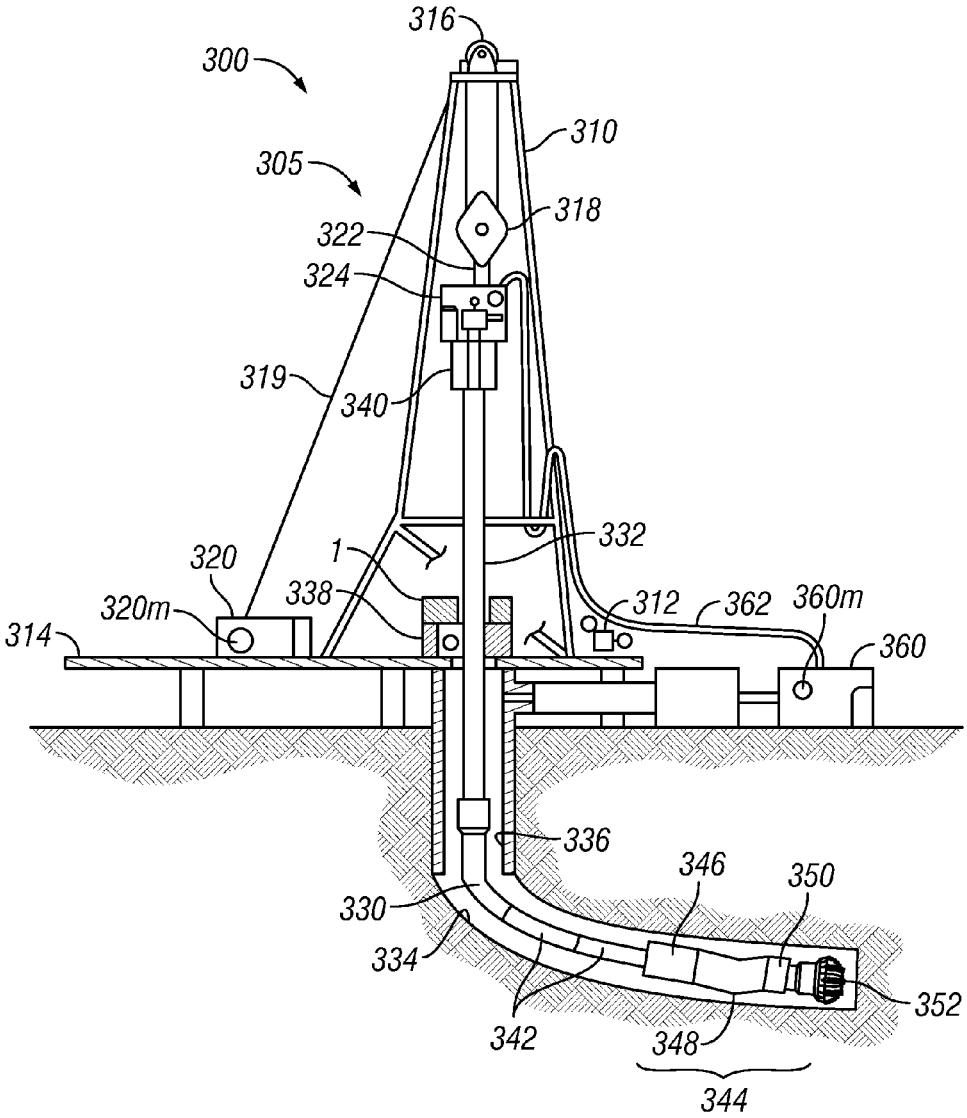
FIG. 1 is a schematic elevation view of an embodiment of a well operation system, including drilling.

The following discussion is directed to various embodiments of the invention. The embodiments disclosed should not be interpreted or otherwise used as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used in the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness. In addition, like or identical reference numerals may be used to identify common or similar elements.

In the following discussion and in the claims, the terms "including" and "comprising" are used in an open-ended fashion, and thus should be interpreted to mean "including, but not limited to . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

A downhole well string is series of joined-together pipes and components configured for work in a borehole. The overall length of the well string is determined by the depth of the borehole in which the string will be used. The particular configuration of the well string is determined by its intended use. Examples of downhole well strings in the oil and gas industry are drill strings, completion strings, and production strings. Strings may include pipe joints, stands of pipe, drill bits, stabilizers, or other downhole components, that are connected together. These components may have different diameters. Thus, the diameter of a well string may vary along its length.

Referring first to FIG. 1, an embodiment of a well operation system 300, is schematically shown. Well operation system 300 includes a drilling rig 305 depicted schematically as a land rig, but other rigs (e.g., offshore rigs and platforms, jack-up rigs, semisubmersibles, drill ships, and the like) are within the scope of the disclosure. The rig 305 includes a derrick 310 that is supported above a rig floor 314. The rig 305 also includes lifting apparatus comprising a crown block 316 mounted to derrick 310 and a traveling block 318 interconnected by a cable 319 that is driven by a drawworks 320 (with a motor or motors 320*m*) to control the upward and downward movement of the traveling block 318. Traveling block 318 carries a hook 322, which suspends a top drive system 324. A power swivel may be used instead of a top drive. The top drive system 324 rotates a drive shaft 332, which rotates a drill string 330 within a borehole 334. The top drive system 324 can be operated to rotate the drill string 330 in either direction. Optionally, the drill string may be rotated by a motor-driven rotary table 338 disposed in a drill floor (e.g., rig floor 314). The drill string 330 is coupled to the top drive system 324 through an instrumented subsystem 340 which includes sensors that provide drilling parameter information. A control system and user interface 312 controls operations of the rig 305.

Well system 300 further includes clamping device 1 for grasping and suspending drill string 330 and/or drive shaft 332 during assembly and disassembly. Clamping device 1 is positioned and mounted around borehole 334 on the rig floor 314 or is coupled to another component, such as a rotary table 338. Clamping device 1 can be installed or removed during well operations, as may be required.

The drill string 330 may be any typical drill string and, in one aspect, includes a plurality of interconnected sections of drill pipe 342, a bottom hole assembly (BHA) 344, which can include stabilizers, drill collars, and/or a suite of measurement while drilling (MWD) instruments including a steering tool 346 to provide bit face angle information. Optionally a bent sub 348 is used with a downhole or mud motor 350 and a drill bit 352. Borehole 334 may have borehole casing 336, comprising primarily cement and pipe.

Referring still to FIG. 1, drilling fluid is delivered to the drill string 330 through a mud hose 362 by mud pumps 360 which are driven by motor or motors 360*m*. The drill string 330 is rotated within borehole 334 by the top drive system 324, the rotary table 338, the mud motor 350, or combinations thereof. The cuttings produced as the bit 352 drills into the earth are carried out of borehole 334 by drilling mud supplied by the mud pumps 360.

Physical Description of a First Embodiment of the Clamping Device

Figure 2:
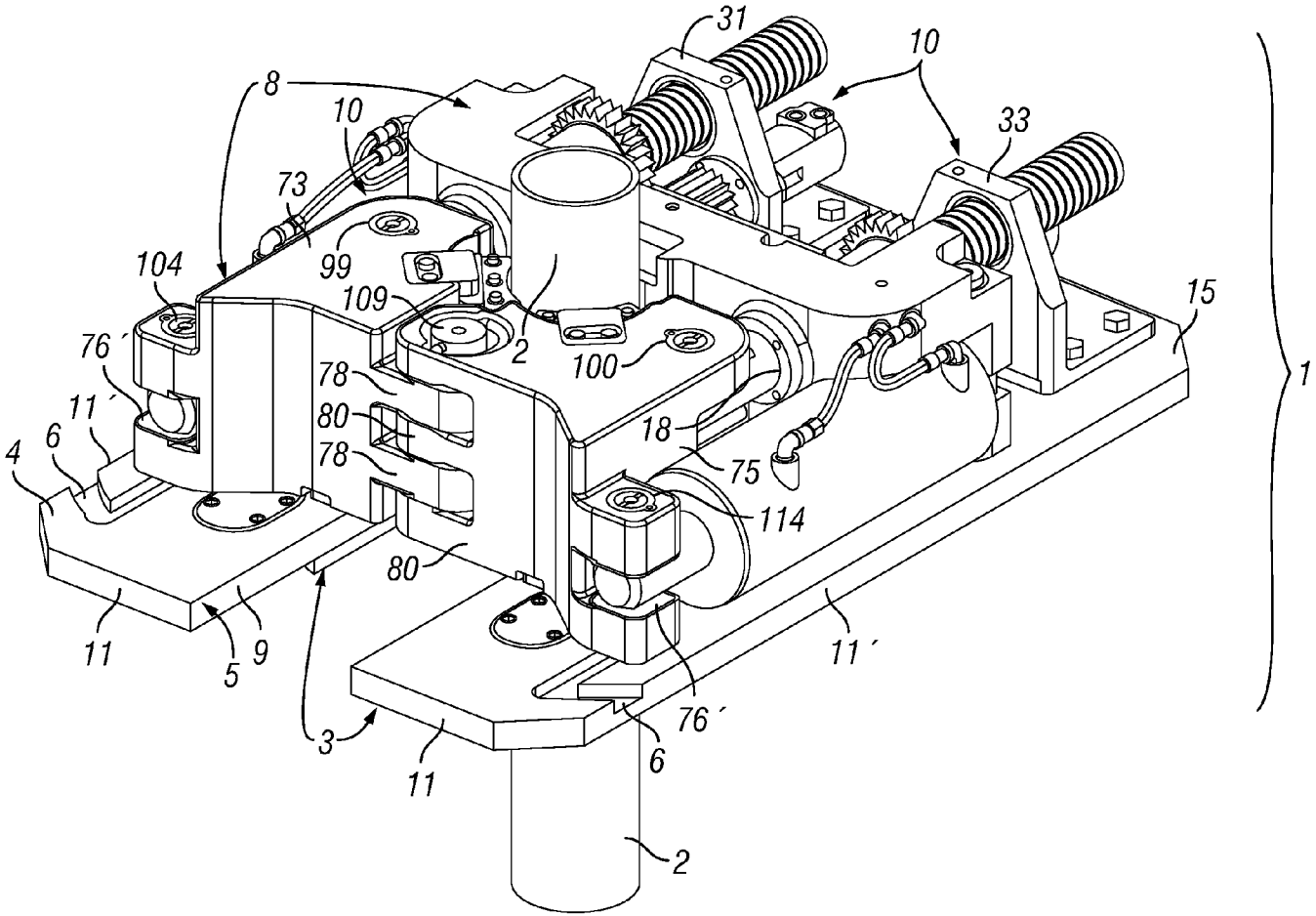
FIG. 2 is a perspective view of a first embodiment of a clamping device for suspending a well string in accordance with the principles described herein.

FIG. 2 is a perspective view of a clamping device 1 for supporting components of a downhole well string. Clamping device 1 comprises a clamp mechanism 8, a drive mechanism 10, and a support structure 3. Drive mechanism 10 operates clamp mechanism 8 to engage or disengage from a component of well string 330 (here a drill pipe joint 2). Support structure 3 holds clamp mechanism 8 and drive mechanism 10 together and supports them and joint 2 against a rotary table 338, the rig floor 314, or another receiving structure.

Support Structure

Figure 3:
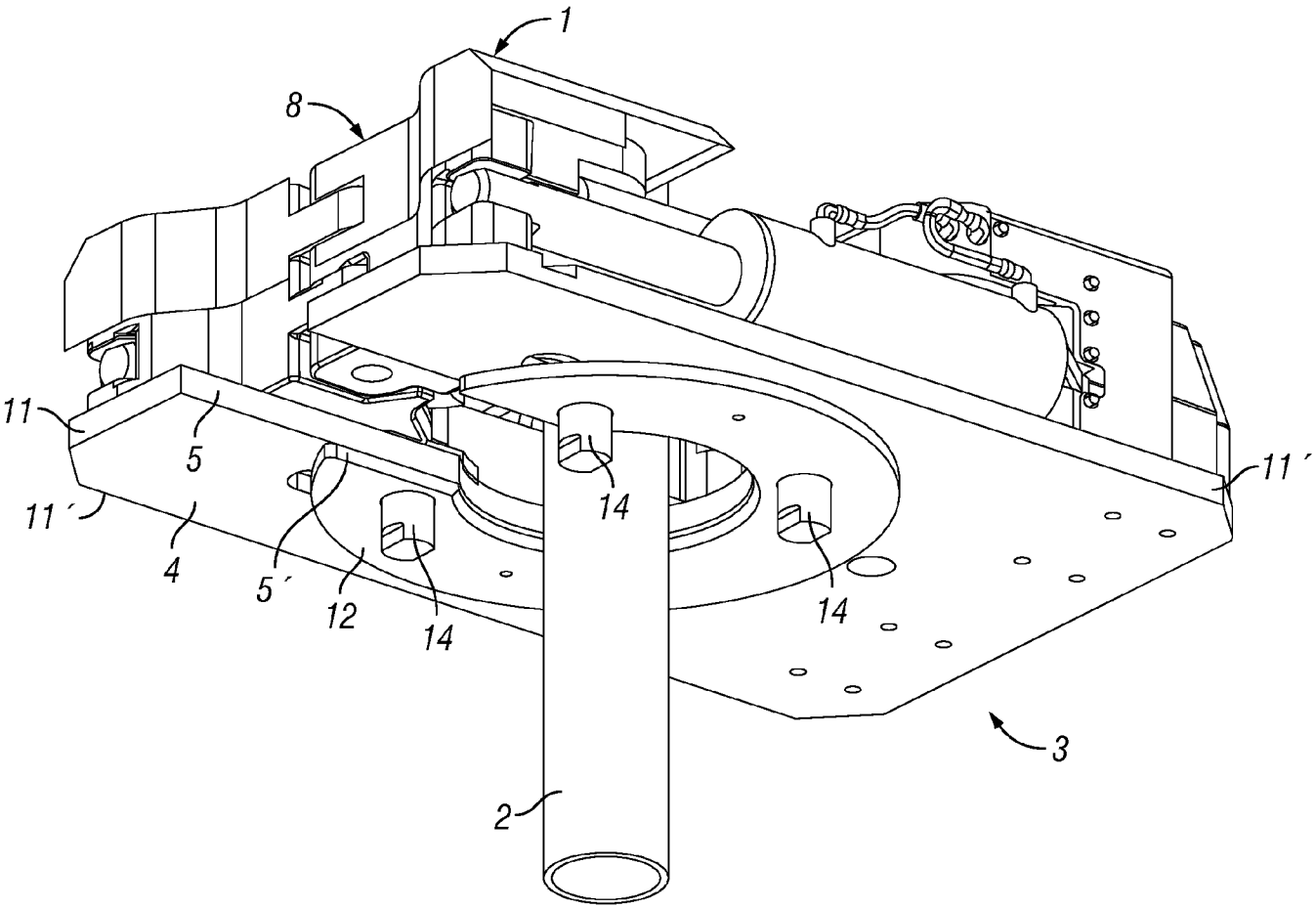
FIG. 3 is a perspective bottom view of the clamping device of FIG. 2

Referring now to FIG. 3, support structure 3 includes a substantially rigid rectangular base plate 4, a substantially annular base plate adapter 12 attached to the bottom of base plate 4, and a plurality of adapter pins 14 attached to and extending downward, beyond the lower surface of base plate adapter 12.

Base Plate Adapter

The annular-shaped base plate adapter 12 in FIG. 3 is configured to fit into a receiving structure, such as a master bushing in a rotary table, e.g. rotary table 338. Base plate adapter 12 can assume several different configurations to match any receiving structure. Some portion of base plate 4 may also be in contact with and be supported directly by the receiving structure. Base plate adapter 12 includes a slot 5' corresponding to slot 5 in base plate 4, which will be described later. The spacing and the cross-sectional shape of adapter pins 14 are configured to match receiving holes or slots (not shown) in the receiving structure.

Base Plate

Figure 4:
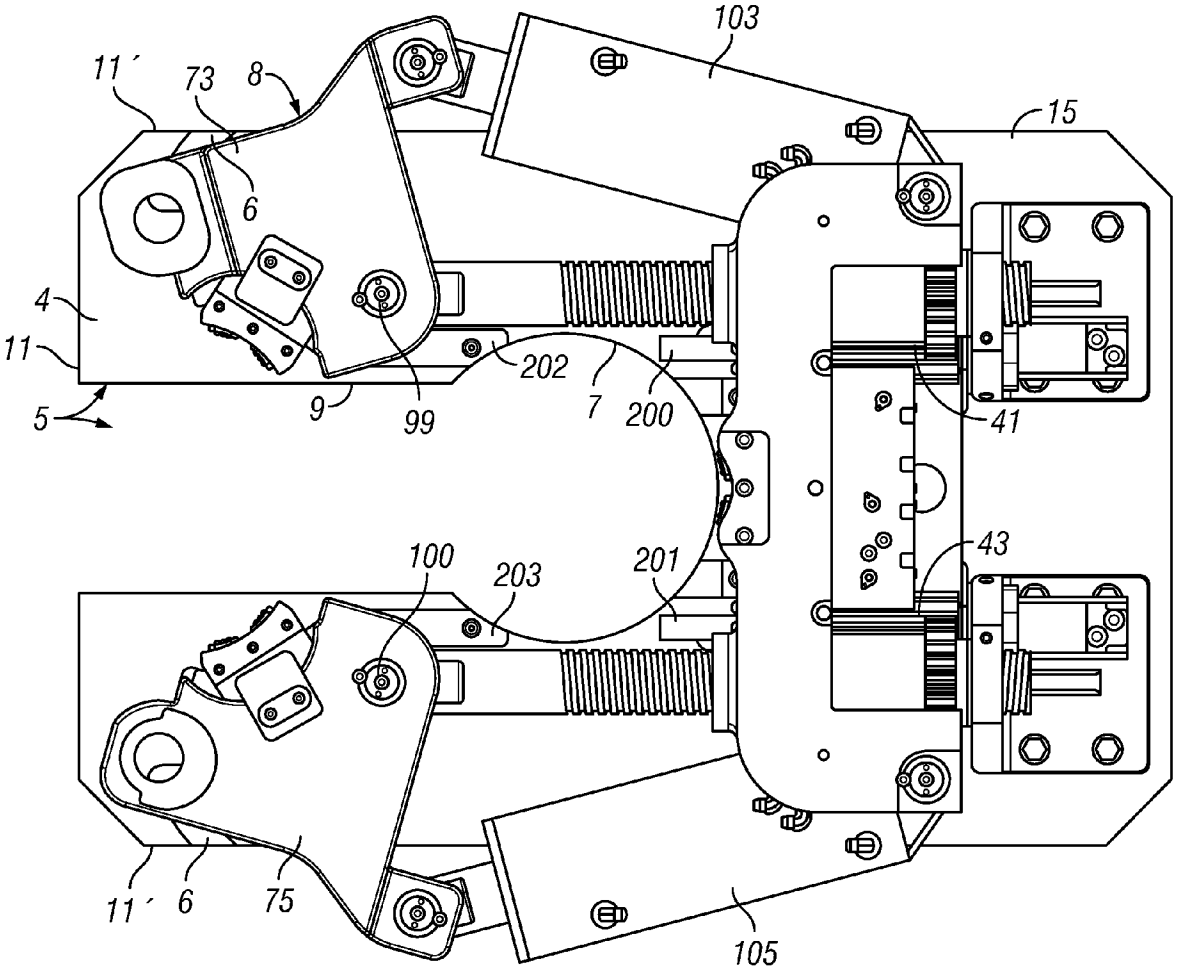
FIG. 4 is a top view of the clamping device of FIG. 2 in a fully-open position, also referred to as the removal mode.

Referring to FIGS. 3 and 4, the base plate 4 has a slot 5 extending in the direction of the longest dimension of base plate 4. Slot 5 is keyhole shaped and includes a central opening 7 and an intersecting side opening 9. The central opening 7 is located at or near the center of base plate 4 and is contiguous with the side opening 9. Side opening 9 runs from the central opening 7 to an outer edge 11 of the base plate 4. The diameter of central opening 7 is larger than the largest diameter component that will be held by clamping device 1. Base plate 4 has two outer edges 11' that are parallel to side opening 9 and perpendicular to edge 11.

Returning to FIG. 2, the top surface 15 of base plate 4 is horizontally disposed and includes two symmetrical, partial depth slots or "base plate channels" 6, one on each side of side opening 9. The majority of the length of each base plate channel 6 runs parallel to side opening 9, but the end of base plate channel 6 that is nearest outer edge 11 extends away from side opening 9 to edges 11' at an obtuse angle. On top surface 15 of base plate 4, guide strips 200, 201, 202, 203 are attached in between and parallel to side opening 9 and the two base plate channels 6.

Clamp Mechanism

Figure 5:
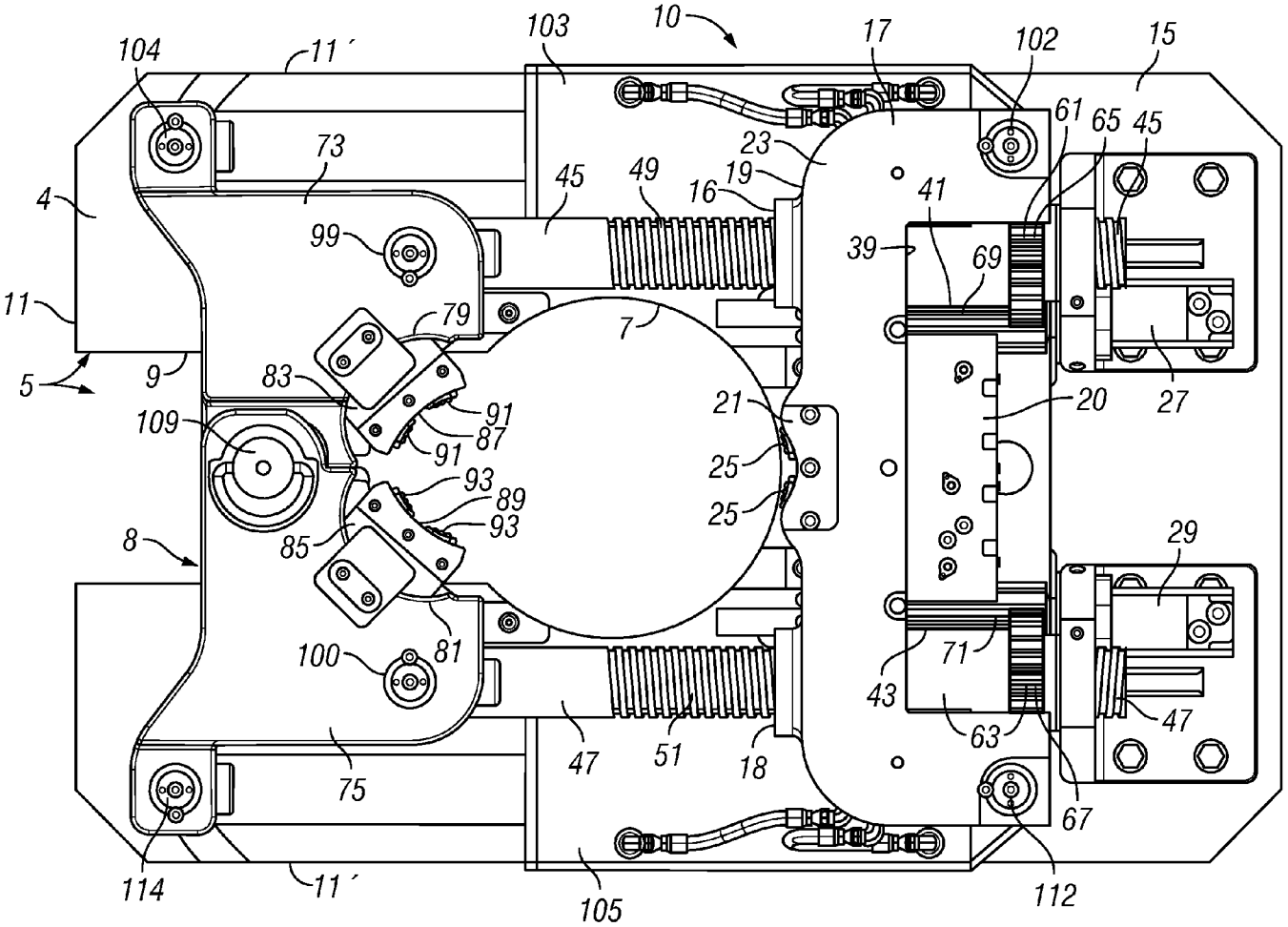
FIG. 5 is a top view of the clamping device of FIG. 2 in operationally-open position.

Referring to FIG. 5, clamp mechanism 8 comprises a plurality of clamps that oppose each other and radially engage joint 2 (FIG. 2) to suspend within central opening 7 joint 2 and the well string components that are attached. Clamp mechanism 8 is slidably mounted on top surface 15 of the base plate 4. In the embodiment of FIG. 5, clamp mechanism 8 has a primary clamp body 17 and two auxiliary clamp bodies 73, 75. Auxiliary clamp bodies 73, 75 are positioned opposite to the primary clamp body 17 and interconnected by pin 109 when they are configured to grasp the joint. As will be described in more detail below, clamp bodies 17, 73, 75 are held and controlled by drive mechanism 10 and move parallel to top surface 15 of base plate 4.

Figure 7:
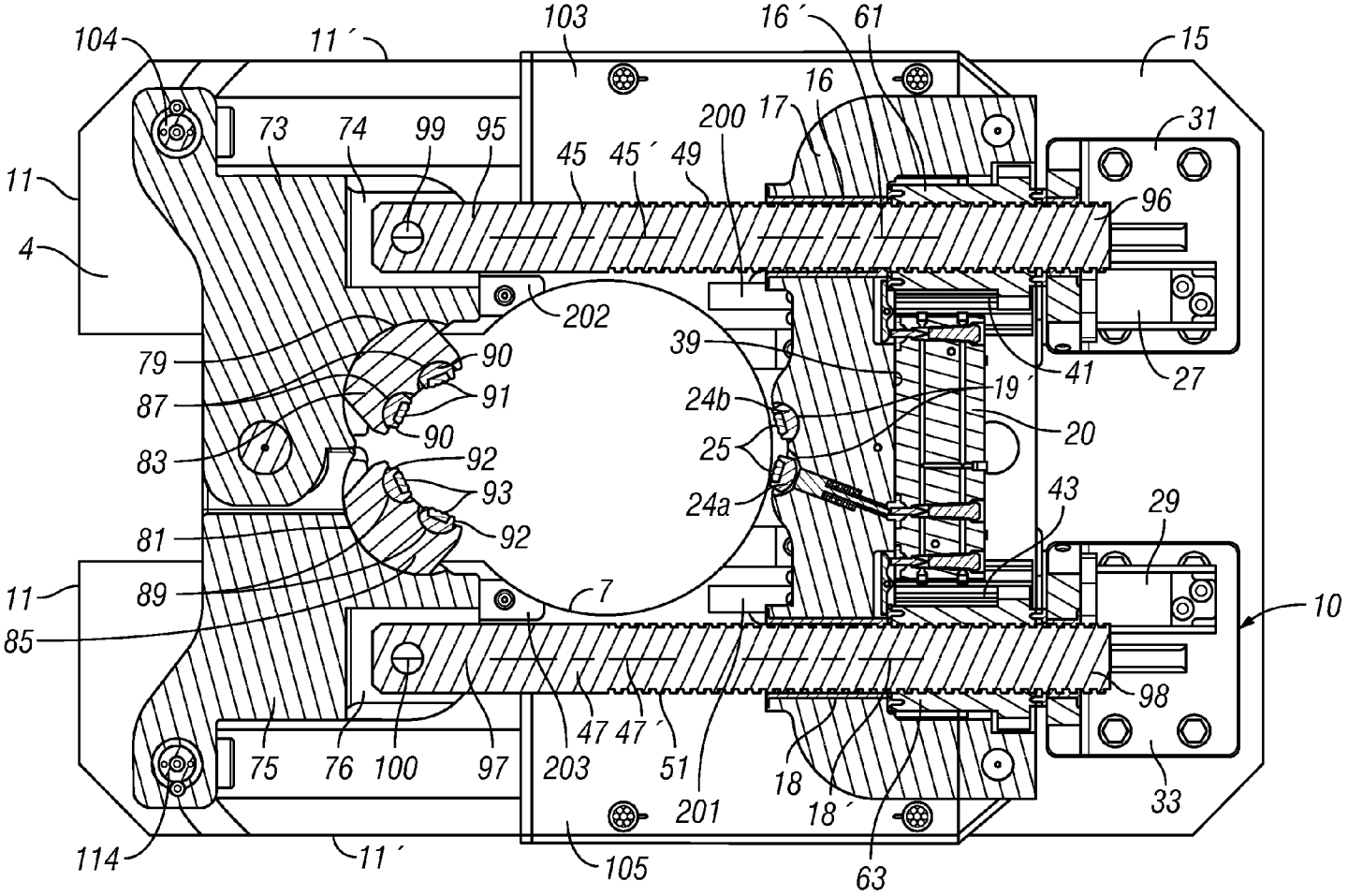
FIG. 7 is a horizontal cross-section of the clamping device of FIG. 2 in operationally-open position.

Referring to FIGS. 5 and 7, primary clamp body 17 has a generally rectangular shape with recesses to receive components of drive mechanism 10 as discussed below. Primary clamp body 17 has a front face 19 facing central opening 7, a top face 23, a back face 39, and two through-holes 16, 18 with central axes 16', 18' that extend parallel to side opening 9 of slot 5 in base plate 4. One hole 16 and its central axis 16' is on one side of side opening 9 and the other hole 18 and its central axis 18' is on the other side of side opening 9. As shown in FIG. 7, a plurality of pivotable die insert holders 24 with imbedded die inserts 25 are mounted within recessed, curved surfaces 19' on front face 19 of primary clamp body 17. The die inserts 25 grip joint 2 that is received in the central opening 7.

Referring again on FIG. 5, die inserts 25 are held in place by two endplates 21. One endplate 21 is mounted on the top face 23 of primary clamp body 17, and the other endplate (not shown) is mounted to the bottom side of primary clamp body 17. Adjacent to back face 39, primary clamp body 17 incorporates a hydraulic control block 20, described in more detail below.

Auxiliary clamp bodies 73, 75, shown in FIGS. 5 and 7, are joined by pin 109 to form a structure of similar size and purpose as primary clamp body 17. Auxiliary clamp bodies 73, 75 are disposed on the opposite side of central opening 7 from primary clamp body 17 and span across side opening 9 in base plate 4 when joined by pin 109. As best shown in FIG. 2, auxiliary clamp bodies 73, 75 include interlocking ribs 78, 80, respectively. Pin 109 is disposed through ribs 78, 80. Auxiliary clamp bodies 73, 75 further include pivot joints 99, 100 that are disposed near central opening 7 of base plate 4, and rotatable joints 104, 114 closer to the outer edges of base plate 4, i.e. edges 11 and 11'. The bottoms of rotatable joints 104, 114 include extended pins (not shown) that extend down into base plate channels 6. In this embodiment, extended pins of pivot joints 104, 114 do not pass through base plate 4, but they do travel in base plate channels 6. Pivot joints 99, 100 and rotatable joints 104, 114 all have vertical axes that are perpendicular to the top face 15 of base plate 4.

Referring to FIG. 7, in the region that includes pivot joints 99, 100, horizontal (i.e. parallel to top face 15) and generally rectangular slots 74, 76 are machined into auxiliary clamp bodies 73, 75, so as to separate pivot joints 99, 100 into an upper and a lower section to receive a member of drive mechanism 10. Pivot joints 99, 100 are independent of and unattached to base plate 4. In the region of rotatable joints 104, 114, horizontal, rectangular slots 74', 76' (FIG. 2) are machined into auxiliary clamp bodies 73, 75, so as to separate pivot joints 104, 114 into an upper and a lower section to receive a member of drive mechanism 10.

Referring still to FIG. 7, auxiliary clamp bodies 73, 75 have concave, vertically-extending surfaces 79, 81 on which insert carriers 83, 85, respectively, are mounted. The back surface of insert carriers 83, 85 conform to concave, vertical surfaces 79, 81. Insert carriers 83, 85 generally face central opening 7 in base plate 4 and generally are circumferentially aligned with central opening 7. Insert carriers 83, 85 have a plurality of concave, vertically-extending surfaces 87, 89 that face central opening 7. A plurality of smaller die insert holders 90, 92 are mounted on surfaces 87, 89, respectively. Die insert holders 90, 92 hold die inserts 91, 93 which have toothed surfaces to grip the circumference of joint 2. The back surface of die insert holders 90, 92 conform to concave, vertical surfaces 87, 89 of insert carriers 83, 85.

The described gripping elements and the curved surfaces incorporated within primary clamp body 17 and auxiliary clamp bodies 73, 75 allow the orientation of die inserts 25, 91, 93 to adjust automatically to the curved surfaces of joint 2 if joint 2 falls within a prescribed range of diameters. Gripping elements are shown and described in U.S. Pat. Nos. 6,971,283 and 7,748,297, the entire disclosure of each being incorporated herein by this reference.

Drive Mechanism

Referring to FIG. 7, drive mechanism 10 comprises a pair of parallel spindles 45, 47, pair of drive motors 27, 29, pair of drive gears 41, 43, pair of locknuts 61, 63, and a pair of fluid-powered cylinders 103, 105. Drive gears 41, 43 are more easily seen in FIG. 6. The drive control system for drive mechanism 10 will be described subsequently. Components that are used in a pairs in this embodiment may be used in greater numbers in other embodiments.

Spindles 45, 47 have leading ends 95, 97, trailing ends 96, 98, and central axes 45', 47' which are co-axial with central axes 16', 18' in primary clamp body 17 and are therefore parallel to side opening 9 in base plate 4. Threads 49, 51 extend from trailing ends 96, 98 across a majority of the lengths of spindles 45, 47. The leading end 95 of spindle 45 is inserted into rectangular slot 74 within the auxiliary clamp body 73, and the leading end 97 of spindle 47 is inserted into a rectangular slot 76 within the auxiliary clamp body 75. The leading ends 95, 97 are coupled to the auxiliary clamp bodies 73, 75 via pivot joints 99, 100. With this arrangement, spindles 45, 47 are fixed to prevent rotation with respect to spindle central axes 45' and 47'.

The trailing end 96 of spindle 45 is inserted into through-hole 16 in the primary clamp body 17, and the trailing end 98 of the spindle 47 is inserted into through-hole 18 in the primary clamp body 17. Therefore, spindles 45, 47 are co-axial with holes 16, 18. Spindles 45, 47 slidably engage the smooth and unthreaded through-holes 16, 18 and can move linearly, relative to primary clamp body 17. Similarly, primary clamp body 17 can slide axially relative to spindles 45, 47. Trailing ends 96, 98 of spindles 45, 47 also slidably engage mounting bracket holes 32, 34 in the vertical portion of the L-shaped mounting brackets 31, 33, which are attached near the end of base plate 4 that is furthest from outer edge 11, as best shown in FIG. 2. Holes 16, 18 and mounting bracket holes 32, 34 may include a smooth bushing to reduce friction.

Referring still to FIG. 7, drive mechanism 10 includes two drive motors 27, 29 that operate simultaneously, but rotate in opposite directions. Drive motors 27, 29 are mounted on the top surface 15 of the base plate 4 and include drive shafts that extend parallel to spindle axes 45', 47', and are disposed near spindle trailing ends 96, 98. The drive motors 27, 29 may be secured to the base plate 4 using mounting brackets 31, 33, or other suitable mounting fixtures. In the embodiment shown, drive motors 27, 29 are hydraulically-powered motors, however other types of motors, e.g., electrically-powered motors, may instead be employed. Drive gears 41, 43, respectively are coupled to drive motors 27, 29 and are disposed near spindle trailing ends 96, 98. Locknuts 61, 63 are mounted on spindles 45, 47 and have internal threads that engage with spindle threads 49, 51. As a result, the locknuts 61, 63 rotate and translate on spindles 45, 47. Locknuts 61, 63 are also adjacent to and matingly engaged with the drive gears 41, 43. As more clearly shown in FIG. 6, locknuts 61, 63 have external teeth 65, 67 that mesh with and slide along the surface of the elongated, external teeth 69, 71 of drive gears 41, 43 and remain engaged with teeth 69, 71 while sliding. Thus, when drive gears 41, 43 are rotated by drive motors 27, 29, the drive gears 41, 43 rotate locknuts 61, 63, and the rotating locknuts 61, 63 move along spindles 45, 47 while simultaneously sliding along elongated external teeth 69, 71. Drive gears 41, 43 are positioned on opposite sides of their respective spindle 45, 47. That is to say, one drive gear is on the right-hand side of its spindle and the other drive gear is on the left-hand side of its spindle. As a result, drive motors 27, 29 must rotate in opposite directions for Locknuts 61, 63 to travel the same direction simultaneously. Threads 49, 51 on spindles 45, 47 and the mating internal threads of locknuts 61, 63 have a small enough thread angle so that locknuts 61, 63 will only rotate on the respective spindle 45 or 47 when a tangential force is applied, such as the tangential force applied by of a rotating drive gear 41 or 43. Locknuts 61, 63 will not rotate when an axial force is applied, such as the reaction force exerted by clamp body 17 while grasping joint 2. Hence the term "locknut" is used to describe components 61 and 63.

Figure 8:
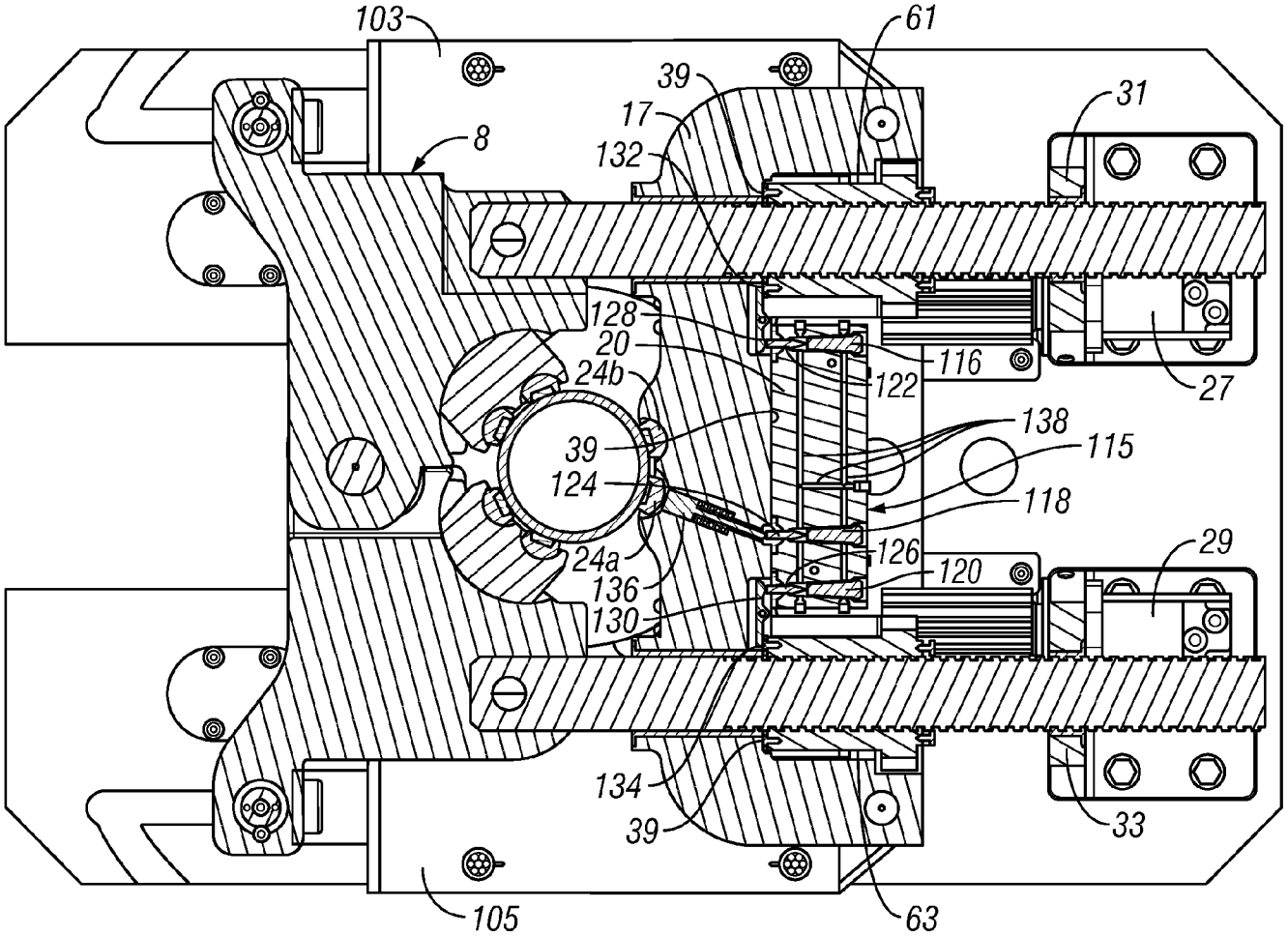
FIG. 8 is a horizontal cross-section of the clamping device of FIG. 2 in operationally-closed position.

As understood from FIGS. 7 and 8, locknuts 61, 63 can travel along spindles 45, 47 in a forward direction toward central opening 7 pushing back face 39 of the primary clamp body 17. The motion of primary clamp body 17 stops when it engages a joint 2 in central opening 7. As shown in FIG. 7, locknuts 61, 63 can also travel in a backward direction until they are stopped by engagement with the mounting fixtures 31, 33. Because locknuts 61, 63 are not affixed to primary clamp 17, locknuts 61, 63, in this embodiment, do not pull clamp 17 to retract it. Instead, clamp 17 is retracted away from central opening 7 by the force of fluid powered cylinders 103, 105.

Referring again to FIG. 5, drive mechanism 10 further includes fluid powered cylinders 103, 105. Fluid powered cylinder 103 is coupled at one end to the primary clamp body 17, via a pivot joint 102, and at another end to the auxiliary clamp body 73, via a rotatable joint 104. Similarly, fluid powered cylinder 105 is also coupled at one end to the primary clamp body 17, via a second pivot joint 112, and is coupled at another end to the auxiliary clamp body 75, via a rotatable joint 114. The fluid powered cylinders 103, 105 are hydraulic cylinders in the embodiment shown, but may be pneumatic cylinders. The fluid powered cylinders 103, 105 are examples of linear actuators. In general, linear actuators, including those not powered by fluid, may be used to accomplish the same purpose as the fluid powered cylinders 103, 105. In some modes of operation, described more fully below, fluid powered cylinders 103, 105 are aligned parallel to spindles 45, 47.

Drive Control System

Figure 9:
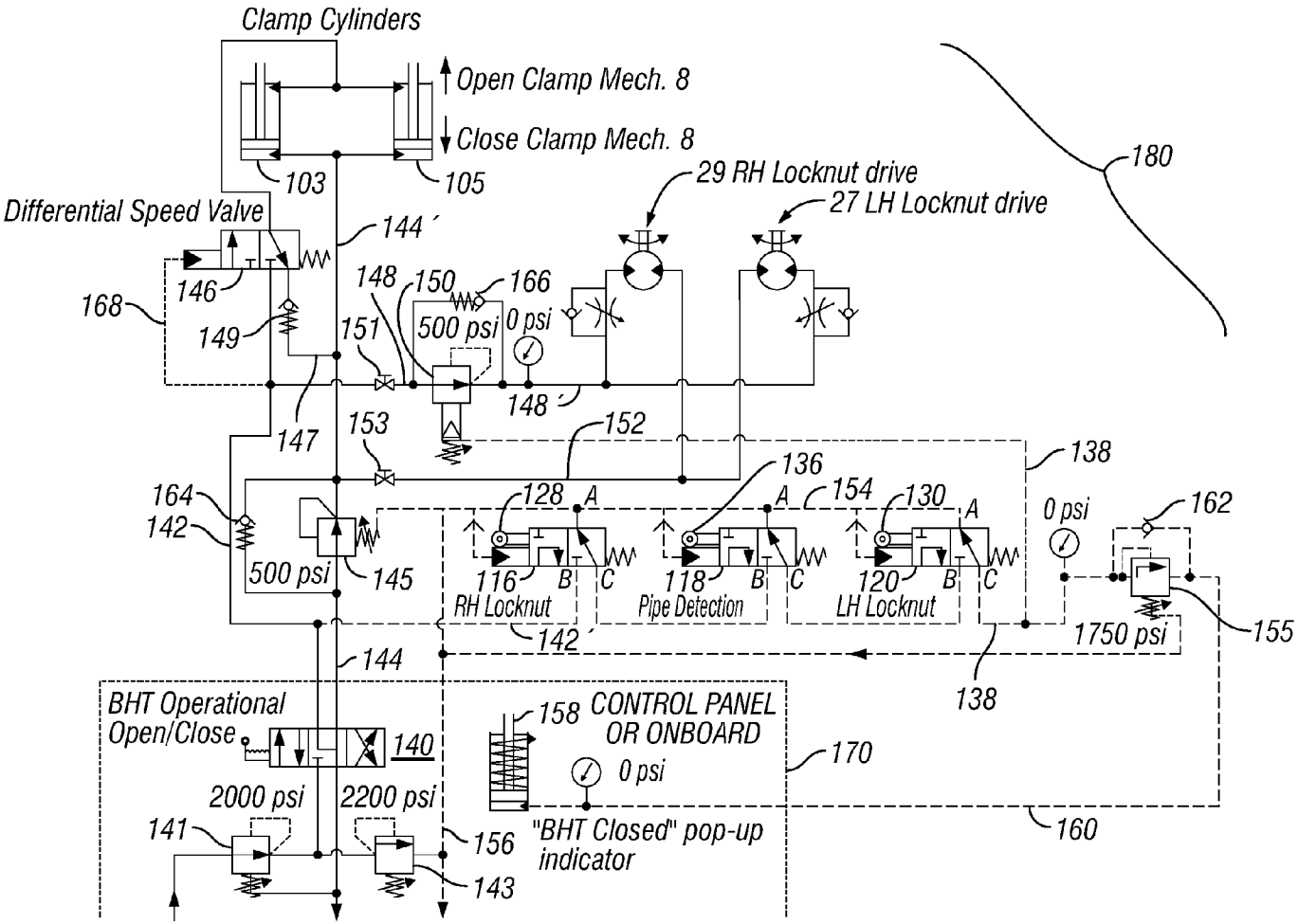
FIG. 9 is a schematic of a drive control system for controlling operation of the clamping device of FIG. 2.

Referring now to FIGS. 8 and 9, drive control system 180 provides hydraulic fluid to drive the sometimes simultaneous movements of fluid powered cylinders 103, 105, drive motors 27, 29, and to detect and react when a joint 2 is gripped in central opening 7. Clamping device 1 includes a force detection mechanism 115 (FIG. 8) for sensing when the locknuts 61, 63 are pushing primary clamp body 17 toward the central opening 7 and when, at the same time, one of the die insert holders 24 is closed against a joint (die insert holder 24*a* in FIG. 8). Force detection mechanism 115 is incorporated into primary clamp body 17 near back face 39 and comprises hydraulic control block 20, cartridge valves 116, 118, 120, push pins 122, 124, 126, levers 128, 130, wear elements 132, 134, spring-loaded pin 136, and pilot line 138 for high pressure hydraulic fluid handling. Wear elements 132, 134 are attached to the leading end of locknuts 61, 63.

Hydraulic control block 20 incorporates the aforementioned cartridge valves 116, 118, 120, push pins 122, 124, and hydraulic passageways for control signals, including pilot line 136. Pilot line 136 communicates high pressure hydraulic fluid within force detection mechanism 115 to provide a signal to the other portions of the drive control system 180 when a joint 2 has been gripped by clamp mechanism 8 (FIG. 2).

As locknuts 61, 63 push primary clamp body 17 toward central opening 7, wear elements 132, 134 abut levers 128, 130 which in turn exert force on the push pins 122, 126 and thereby open the cartridge valves 116, 120. As travel continues, die insert holder 24, carried by primary clamp body 17, eventually contacts and presses against joint 2, which causes die insert holder 24 to also press against an adjacent, spring-loaded pin 136 embedded in primary clamp body 17. Spring-loaded pin 136 presses against push pin 124, which pushes and opens the third valve, cartridge valve 118. Cartridge valves 116, 120 remain open as described above. Once all three cartridge valves 116, 118, 120 are open, high pressure hydraulic fluid via pilot line 138 passes to another portion of drive control system 180 for a response (described below). The three cartridge valves 116, 118, 120 are plumbed in series, so all valves must be open simultaneously before a hydraulic signal is sent. Alternatively, levers 128, 130 and spring-loaded pin 136 could each push against a dedicated proximity sensor to send separate electrical signals to drive control system 180 when joint 2 is gripped. Drive control system 180 could easily be adapted to accept and utilize these signals.

FIG. 9 shows a schematic of a drive control system 180 for controlling operation of clamping device 1. Fluid supply line 139 conveys pressurized hydraulic fluid from a pump or a supply reservoir (not shown) to pressure reducing valve 141 (set to the system operating pressure), which feeds a directional control valve (four-way, three-position, four-port) 140. A pressure relief valve 143 (set to the system safety pressure) is disposed between pressure reducing valve 141 and directional control valve 140 to protect the system against overpressurization. For example, in the embodiment shown, valves 141, 143 may be set to 2000 psi and 2200 psi, respectively. Directional control 140 is also connected to fluid powered cylinders 103, 105 via fluid lines 142, 144. Directional control valve 140 determines whether fluid powered cylinders 103, 105 extend or retract, and determines the rotational direction of drive motors 27, 29. When directional control valve 140 supplies pressurized fluid to fluid line 142, fluid enters the rod ends of fluid powered cylinders 103, 105, which retract, causing clamp bodies 17, 73, 75 to be drawn together towards joint 2 (FIG. 8). Alternatively, when pressurized fluid is supplied to fluid line 144, fluid enters the cap ends of fluid powered cylinders 103, 105, which extend, causing clamp mechanism 8, i.e. clamp bodies 17, 73, 75 to move apart, and thus to release joint 2. A pressure reducing valve 145 is disposed in the fluid lines 144 and 144' leading to the cap end of fluid powered cylinders 103, 105 and to drive motors 27, 29 (via valve 153) to provide low pressure fluid during opening of clamp bodies 17, 73, and 75. In this example, reducing valve 145 may be set at 500 psi. However, when closing clamp mechanism 8, fluid flowing in the opposite flow direction, i.e.

returning from line 144' to line 144, by-passes valve 145, choosing instead to travel through check valve 164.

A directional control valve (three-way, two-position, three-port) 146 is disposed in the fluid line 142 to control the rate at which fluid fills the cap-end of the cylinders 103, 105 while cylinders 103, 105 extend to open clamp mechanism 8. To do this, first, directional control valve 140 delivers fluid to fluid lines 144 and 144'. Simultaneously, directional control valve 146 is shifted to a first or "opening" position by the integrated spring within valve 146, as configured in the position shown in FIG. 9. Thus, the "opening" position of valve 146 is equivalent to its "home" position. In this opening position, directional control valve 146 discharges fluid from the rod ends of the cylinders 103, 105 through spring-loaded check valve 149 and into the pressurized line 144' that is filling the cap ends. This is possible because on the rod ends of cylinders 103, 105, the area of the pistons that pushes and discharges hydraulic fluid is annular. Therefore, rod-end area is smaller than the full circular area of the same piston at the cap end. When pressure from fluid line 144 enters fluid line 144' and then pressurizes the cap end of cylinders 103, 105, a force is exerted on the cap end of the pistons (The force exerted by the fluid on the cap end of the piston is equal to the pressure in fluid line 144' multiplied by the area of the cap end of the piston.). With some loss for friction, a nearly equal force is exerted on the fluid in the rods ends. However, because the rod ends have a smaller area, yet the same force is exerted by the piston, the resulting pressure in the rod-end is greater than the pressure in the cap end that is filling. (The resulting fluid pressure in the rod end is equal to the force exerted by the piston divided by the area of the rod end of the piston.) With an elevated pressure, fluid from the rod end is then capable of traveling through directional control valve 146, through spring-loaded check valve, and into fluid line 144'. The additional volumetric flow of fluid to the cap end of cylinders 103, 105 increases the rate of extension. It should be noted that for every unitary distance of travel (e.g. one inch) of a piston, the rod end will discharge less fluid than is required to fill the expanding cap end, so fluid can continue to flow from both check valve 149 and fluid line 144.

When shifted to a second or "closing" position, directional control valve 146 is set to close the clamp mechanism 8 by directing fluid to the rod ends of cylinders 103, 105. Of course, directional control valve 140 must first deliver pressurized fluid to fluid line 142. Line 142 then pressurizes fluid pilot line 168, which changes the position of directional control valve 146. Described with reference to FIG. 9, the internal piston of valve 146 would be shifted to the right. At the same time, fluid in line 142 is ready to enter valve 146. In the second position, directional control valve 146 allows fluid from line 142 to pass but has no other influence on the fluid flow rate to cylinders 103, 105. Therefore cylinders 103, 105 constrict (retract) at a "normal" speed, a speed influenced by the system pressure. The clamp body 17 and the coupled pair of clamp bodies 73, 75 draw closer to each other.

Alternatively, while opening clamp mechanism 8, directional control valve 146 could remain in the second position so that line 142 was always in communication with the rod-end of cylinders 103, 105. In this alternative scenario, the extension and retraction of cylinders 103, 105 would occur at the same "normal" speed, a speed influenced by the system pressure.

Fluid lines 148 and 148' connect fluid line 142 to one of the sides of each of the drive motors 27, 29. The other sides of the drive motors 27, 29 are connected to the fluid line 144' via fluid line 152. For a given mode of operation—opening or closing—the motors 27, 29 both receive pressurized fluid from the same source, either line 148 or line 152. However, the motors are individually plumbed so that for a given mode of operation, they rotate in opposite directions. Drive motors 27, 29 each rotate in opposite, prescribed directions in response to fluid pressure in the fluid line 148 to close clamp mechanism 8. Both drive motors 27, 29 reverse their directions in response to fluid pressure in the fluid line 152 to open clamp mechanism 8. After both motors 27, 29 reverse, drive motor 27 once again rotates in an opposite direction from drive motor 29.

Shut off valves 151, 153 are disposed in the fluid lines 148, 152 to isolate drive motors 27, 29 when operating in the "removal mode" (FIG. 4), described below. Returning to FIG. 9, a pressure reducing valve 150 is disposed in between the fluid line 148 and fluid line 148' to limit the pressure reaching drive motors 27, 29 to a predetermined value, e.g., 500 psi while closing clamp mechanism 8. In the opposite flow direction, when opening clamp mechanism 8, returning fluid from motor 27, 29 enters line 148' but by-passes valve 150, choosing instead to travel through check valve 166 in order to reach line 148. Pressure reducing valve 150 has no effect on the pressure and speed of cylinders 103, 105. It was already stated that another pressure reducing valve, valve 145, reduces the pressure for both drive motors 27, 29 and cylinders 103, 105 while opening clamp mechanism 8.

While clamp mechanism 8 closes and before joint 2 or other component has been grasped, the motors 27, 29 operate at a low pressure regulated by valve 150. After contacting and grasping a joint, as detected through cartridge valves 116, 118, 120, the motors 27, 29 are switched to a high torque clamping mode via the pilot line (138 in FIG. 8). To describe how the high torque clamping mode operates, the requisite plumbing will first be explained. Each of the cartridge valve 116, 118, 120 has three active ports "A," "B," and "C." The first port, port-A, is shown at the top of each cartridge valve 116, 118, 120 in FIG. 9. The first port, port-A, acts as normally-connected discharge port and is connected to a fluid return line 154, which is connected to a fluid return line 156, leading back to the hydraulic fluid reservoir. The second or inlet port of cartridge valve 116, port-B, receives fluid from cartridge valve supply line 142', which is fed from directional control valve 140 via fluid line 142. Next, the third port of cartridge valve 116, port-C, is connected in series to port-B of cartridge valve 118. In turn, port-C of cartridge valve 118 is connected in series to port-B of cartridge valve 120. Finally, port-C of cartridge valve 120 is connected to pilot line 138 and sequence valve 155. The other end of pilot line 138 is connected to the control signal input on pressure reducing valve 150, which controls the pressure of the fluid in line 148' that is delivered to drive motors 27, 29.

While clamp mechanism 8 closes around joint 2, the high torque clamping mode is initiated when cartridge valves 116, 118, 120 are simultaneously activated by lever 130, by spring-loaded pin 136, and by lever 128, respectively. This concurrence of events causes high pressure hydraulic fluid from cartridge valve supply line 142' to pass sequentially through each cartridge valve 116, 118, 120 and to finally reach pilot line 138 and sequence valve 155. High pressure fluid in pilot valve 138 adjusts pressure reducing valve 150 and increased fluid pressure is allowed to pass from fluid line 148 to drive motor supply line 148', increasing the torque of motors 27, 29 and thereby increasing the grip of clamping bodies 17, 73, 75 on joint 2. While clamp mechanism 8 closes around joint 2, high pressure hydraulic fluid is always available to fluid powered cylinders 103, 105.

Continuing with the high torque clamping mode, sequence valve 155, which is set at a predetermined pressure, e.g., 1750 psi, passes the high pressure signal via a fluid line 160 to a grip indication device 158 and control panel 170, notifying the operator and/or other components of the drive control system 180 that a joint 2 is being gripped by clamping device 1. Subsequently, drive control system 180 could communicate the message from sequence valve 155 or from grip indication device 158 to the control system and user interface 312 of well operation system 303.

Later, at a time after an operator sends a signal, and drive mechanism begins to reverse and release joint 2, lever 130, spring-loaded pin 136 and lever 128 release their force against the spring loaded cartridge valves 116, 118, 120, which close. Each cartridge valve 116, 118, 120 once again connects its own port-C to its own port-A releasing the high pressure to fluid return line 154 and ultimately to fluid return line 156. In this process, high pressure fluid drains from pilot line 138 through cartridge valve 120, returning the pressure reducing valve 150 to its normal, lower set point and reducing the fluid pressure supplied to drive motors 27, 29. At the same time, pressurized fluid from grip indication device 158 flows back through indicator fluid line 160 and a check valve 162, by-passing sequence value 155, traveling through cartridge valve 120, and ultimately reaching fluid return line 156.

In the embodiment shown in FIG. 9, grip indication device 158 is a spring-return, single-acting cylinder. However, other types of indication devices may be used instead, e.g., a pressure switch. The location of the control valve 140, pressure reducing valve 141, relief valve 143, and signaling or grip indication device 158 can be on a separate drive system control panel 170, which may be equipped with several options to control safety "interlocks" for clamping device 1 or to communicate with control system and user interface 312, which has over-all control of well operation system 300. Drive system control panel 170 may be equipped with the capability to control other tools like Power Slips (not shown). If a separate drive system control panel 170 is used, only two high pressure fluid lines are required between clamping device 1 and the drive system control panel 170. These lines are the fluid lines 142, 144, which alternate between supply and return to drive fluid powered cylinders 103, 105 and drive motors 27, 29. Two additional low pressure lines are provided as well. One is the dedicated fluid return line 156, and the other is indicator fluid line 160.

General Operation of the First Embodiment of the Clamping Device

Additional details about the operation of the above-described clamping device 1 will now be described. Clamping device 1 has three primary modes within its operational sequence or cycle. These modes are operationally-closed, operationally-open, and removal. The modes will be discussed sequentially. The physical arrangement and purpose of the mode will be first described. Then the method of transitioning to the mode from the previous mode will be described.

Operationally-Closed Mode

Figure 6:
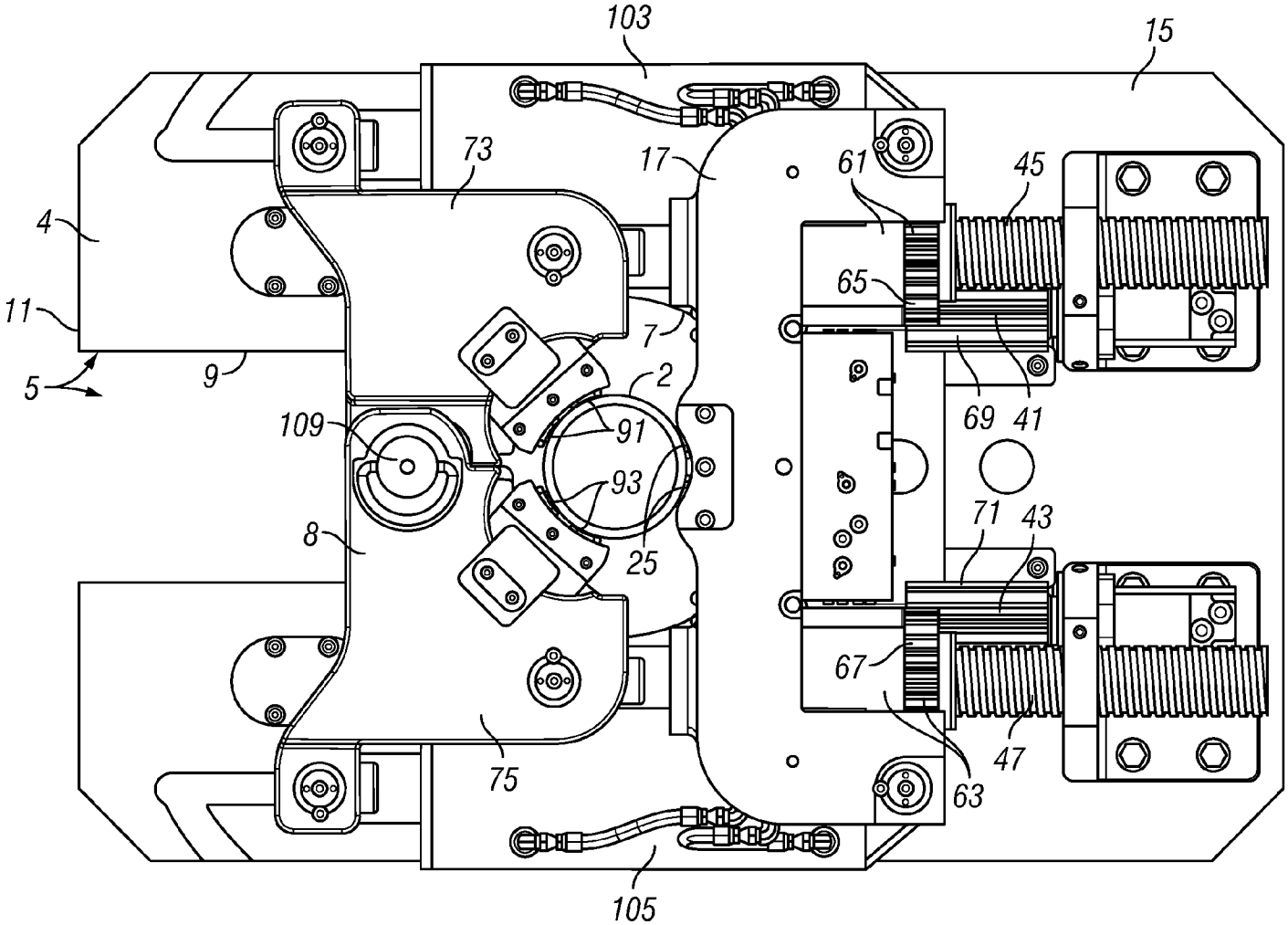
FIG. 6 is a top view of the clamping device of FIG. 2 in operationally-closed position.

The operationally-closed mode of clamping, device 1, is best understood with reference to FIGS. 2, 6, and 8. In this mode, clamp mechanism 8 radially engages a pipe joint 2, which may be a component of a well string, such as drill string 330 in FIG. 1. There would be additional components attached below and possibly above joint 2. The additional components attached below the joint 2 could extend into borehole 334 below clamping device 1. The clamp mechanism 8 is capable of gripping joints and other components with diameters falling within a predefined range of diameters, e.g. 6 to 10 inches in one embodiment. This gripping range is particularly useful in the case of a bottom-hole assembly that may include components with different diameters. The predefined range can encompass all the different diameters present in the bottom-hole assembly. The clamp mechanism 8 would simply be opened further or closed further by the drive mechanism 10 to grip the different parts of the bottom-hole assembly, e.g., during running of a bottom-hole assembly 344 into borehole 334 or retrieval of the bottom-hole assembly 344 from borehole 334. Adjustment of the clamp mechanism 8 does not require replacing or removing any parts of the clamp mechanism 8 for diameters falling within the predefined range. For a new predefined range, parts of the clamp mechanism 8, such as insert carriers 83, 85, can be replaced. After the replacement of parts, the clamp mechanism 8 would grip joints with diameters falling within the new predefined range. As an example, for the described embodiment, the predefined ranges of diameters that can be selected for clamping include 4 to 6 inches, 6 to 10 inches, and 8 to 12 inches; however other ranges are possible.

Clamping device 1 can hold vertical loads (e.g., the weight of joint 2 and other joints and components attached to joint 2), horizontal forces, and clockwise or counterclockwise torque applied along the axis of joint 2. Thus, clamping device 1 can be used as a back-up tool when making-up or breaking-out connections between joints.

The clamping force holding joint 2 is determined by the hydraulic pressure applied to drive mechanism 10 and is independent of the weight of joint 2 and independent the weight of the drill string that may be attached to joint 2. This ability to specify the clamping force independent of the load is provided to allow the system to support greater load weights without crushing the clamped component, e.g. joint 2. This differs from the conventional use of slips where the gripping force on the component is directly related to the weight being supported and where excessive radial force is sometimes applied to the supported component.

Through base plate 4, clamping device 1 may be coupled to any suitable structure, e.g., rotary table 338 or rig floor 314 above borehole 334. When clamping device 1 is mounted to a receiving structure by means of base plate adapter 12 under base plate 4, base plate adapter 12 will be able to transfer to the receiving structure the vertical, horizontal, and torque loads concurrently or separately applied to the clamp mechanism 8 by the supported load. Alternatively, a portion or all of base plate 4 may be in contact with and be supported directly by the receiving structure.

The load forces and torque from the supported load will be transferred from the clamp mechanism 8 to guide strips 200, 201, 202, 203 (FIG. 7) and to drive mechanism 10, including mounting brackets 31, 33, and to joints 104, 114. The load forces and torque are next transferred to base plate 4, including base plate channels 6, in which joints 104, 114 rest, and then to base plate adapter 12, and to the receiving structure.

Operationally-Open Mode

The operationally-open mode of clamping device 1 is best described with reference to FIG. 5. In this mode, the die inserts 25, 91, 93 have disengaged from the joint, which is no longer shown in the central opening 7. Carried by primary clamp body 17 and auxiliary clamp bodies 73, 75, the die inserts 25, 91, 93 have moved away from the center of the central opening 7 to its periphery. To move from the operationally-closed mode to the operationally-open mode (from FIG. 6 to FIG. 5), cylinders 103, 105 are moved to the extended position. Extension of cylinders 103, 105 moves the pair of auxiliary clamp bodies 73, 75 and the single primary clamp body 17 away from each other, in a direction parallel to the base plate 4, and away from the center of the central opening 7. At the same time, the drive gears 41, 43 rotate to drive the locknuts 61, 63 in a reverse direction. As the locknuts 61, 63 are driven in the reverse direction, they rotate and translate along the spindles 45, 47 until they abut the mounting brackets 31, 33. As stated earlier, locknuts 61, 63 are not attached to primary clamp body 17 and therefore do not pull primary clamp body 17 away from central opening 7. Instead, as fluid powered cylinders 103, 105 extend, the pair of auxiliary clamp bodies 73, 75 and the single primary clamp body 17 are pushed away from one another and therefore away from central opening 7. Because the clamp mechanism 8 and drive mechanism 10 are not rigidly fixed to base plate 4, but rather float laterally on base plate 4, the pattern of movement of the clamp bodies 17, 73, 75 during retraction is not prescribed until the extended pins at the bottom of rotatable joints 104, 114 reach the far end (left side, as viewed in FIG. 5) of base plate channels 6, or until locknuts 61, 63 abut mounting brackets 31, 33 and primary clamp body 17 reaches and abuts locknuts 61, 63. That is to say, as fluid powered cylinders 103, 105 extend, auxiliary clamp bodies 73, 75 may first reach the left side of base plate 4, or primary clamp body 17 may first reach the right side of base plate 4, or these events could happen simultaneously. Later, when changing to the operationally-closed mode, this lateral "floating," allows clamp mechanism 8 and drive mechanism 10 to self-center on a joint 2 dispose in central opening 7, even if joint 2 is not in the middle of central opening 7. In the operationally-open mode, like the operationally-closed mode, the cylinders 103, 105 remain parallel to the spindles 45, 47.

Removal Mode

The removal mode or fully-open position of clamping device 1 is shown in FIG. 4. In this mode, the connecting pin 109 (FIG. 2) has been removed from the auxiliary clamp bodies 73, 75, and auxiliary clamp bodies 73, 75 have been rotated about the pivot joints 99, 100 and relative to the base plate 4. As a result, slot 5 in base plate 4 is not obstructed, and lateral access to the central opening 7 is possible via the side opening 9. While in the removal mode, the entire clamping device 1 can be removed from or placed over borehole 334, whether or not a drill string 330 is already disposed in borehole 334 and possibly extending out from borehole 334. The central opening 7, when aligned with borehole 334, can receive joint 2 of drill string 330 that is disposed in borehole 334 or being run into or removed from the borehole 334.

Before changing to the removal mode, the clamping device 1 must be first placed in the operationally-open mode so that auxiliary clamp bodies 73, 75 are fully positioned at the left side of base plate 4. To move from the operationally-open mode to the removal mode (from FIG. 5 to FIG. 4), drive motors 27, 29 are isolated from hydraulic fluid pressure by shut-off valves 151, 153 and do not rotate so as to keep pivot joints 99, 100 at their current positions without moving laterally. Pin 109 is removed from the auxiliary clamp bodies 73, 75. Fluid powered cylinders 103, 105 are then retracted. This imparts a rotational motion on auxiliary clamp bodies 73, 75 about the pivot joints 99, 100, and auxiliary clamp bodies 73, 75 move outwardly and away from slot 5. As auxiliary clamp bodies 73, 75 rotate, the extended pins (not shown) of rotatable joints 104, 114 move out from the side openings of the base plate channels 6 and away from base plate 4. In the removal mode, the central opening 7 is accessible through the side opening 9, and the die inserts 25, 91, 93 are not positioned to grip a joint disposed in the central opening 7.

In the removal mode, clamping device 1 can be removed from a position above the borehole 334 by moving it laterally. This feature is particularly useful if there are other structures or pieces of equipment above borehole 334. The design of clamping device 1 makes it possible to remove clamping device 1 from a position above borehole 334 with little or no disturbance to the other structures or equipment vertically-aligned and overhead. The same is true when installing clamping device 1 above borehole 334, which is also accomplished using the "removal mode." In the removal mode, the cylinders 103, 105 move to a position that is angled, and thus no longer parallel, relative to the spindles 45, 47.

To change from the removal mode back to the operationally-open mode (from the position shown in FIG. 4 to the position shown in FIG. 5), cylinders 103, 105 are extended while drive motors 27, 29 are isolated and not rotating. This swings the auxiliary clamp bodies 73, 75 towards the slot 5. The extended pins of rotatable joints 104, 114 enter and move through the side openings of the base plate channels 6 and toward side opening 9 of slot 5. Auxiliary clamp bodies 73, 75 return to their former position in the operationally-open mode (FIG. 5). The auxiliary clamp bodies 73, 75 can then be secured together using the connecting pin 109. Once the operationally-open mode is achieved, clamp mechanism 8 prevents lateral access to the central opening 7 from the side opening 9.

To move from the operationally-open mode to the operationally-closed mode (from the position shown in FIG. 5 to the position shown in FIG. 6), cylinders 103, 105 contract and move auxiliary clamp bodies 73, 75 relative to primary clamp body 17. In this manner, clamp bodies 17, 73, 75 move towards central opening 7. Simultaneously, drive gears 41, 43 rotate locknuts 61, 63 so that the locknuts travel along spindles 45, 47 towards central opening 7. The locknuts 61, 63 engage and push primary clamp body 17 in the same direction. These simultaneous actions draw clamps 17, 73, 75 together around joint 2.

Referring to FIG. 6, while in the operationally-closed mode, die inserts 25, 91, 93, associated with clamp bodies 17, 73, 75, radially grip the joint 2 that is disposed in the central opening 7. The positions of the die inserts 25, 91, 93 are self-adjustable to accommodate a large-diameter well string component or a small-diameter component within a pre-defined range of diameters. As clamp bodies 17, 73, 75 move parallel to the base plate 4 and toward or away from the center of the central opening 7, the positions of the die inserts 25, 91, 93 adjust to match the diameter of the joint to be gripped. The spindles 45, 47 and guide strips (200, 201, 202, 203) define the parallel linear paths along which clamp bodies 17, 73, 75 travel. In the operationally-closed mode, the cylinders 103, 105 are parallel to the spindles 45, 47 and to each other and are in the retracted position. Both the fluid powered cylinders 103, 105 and the drive motors 27, 29 apply clamping force to the clamp bodies 17, 73, 75 when the clamp bodies 17, 73, 75 engage a joint. As shown in FIG. 8, the locknuts 61, 63 are engaged with the back face 39 of the primary clamp body 17. The locknuts 61, 63 and spindles 45, 47 mechanically lock the clamp bodies 17, 73, 75 in any (variable) position to accommodate the joint size. Locknuts 61, 63 hold their position along spindles 45, 47 even if the power to drive motors 27, 29 is lost. This locking is a mechanical back-up safety feature in case there is a power failure in drive control system 180.

Returning to FIGS. 8 and 9, indication device 158 is used to indicate when clamping device 1 is in the operationally-closed mode, i.e. is gripping a joint 2. Clamping device 1 is in the operationally-closed mode when all the valves 116, 118, 120 are activated. In this mode, high pressure fluid is supplied to drive motors 27, 29 (via the pilot line 138) to enable the clamp mechanism 8 to tighten its grip on joint 2.

Clamping device 1 may be used in conjunction with well operation system 300 during any or during several stage(s) of operation. For example, it may be used during investigative probing, during initial drilling, during continuation drilling after casing and cement have been added to some or all of a borehole, and/or during production. Consequently, clamping device 1 may be used with exploratory wells, production wells, or other well-related operations.

Physical Description of the Second Embodiment of the Clamping Device

Figure 10A:
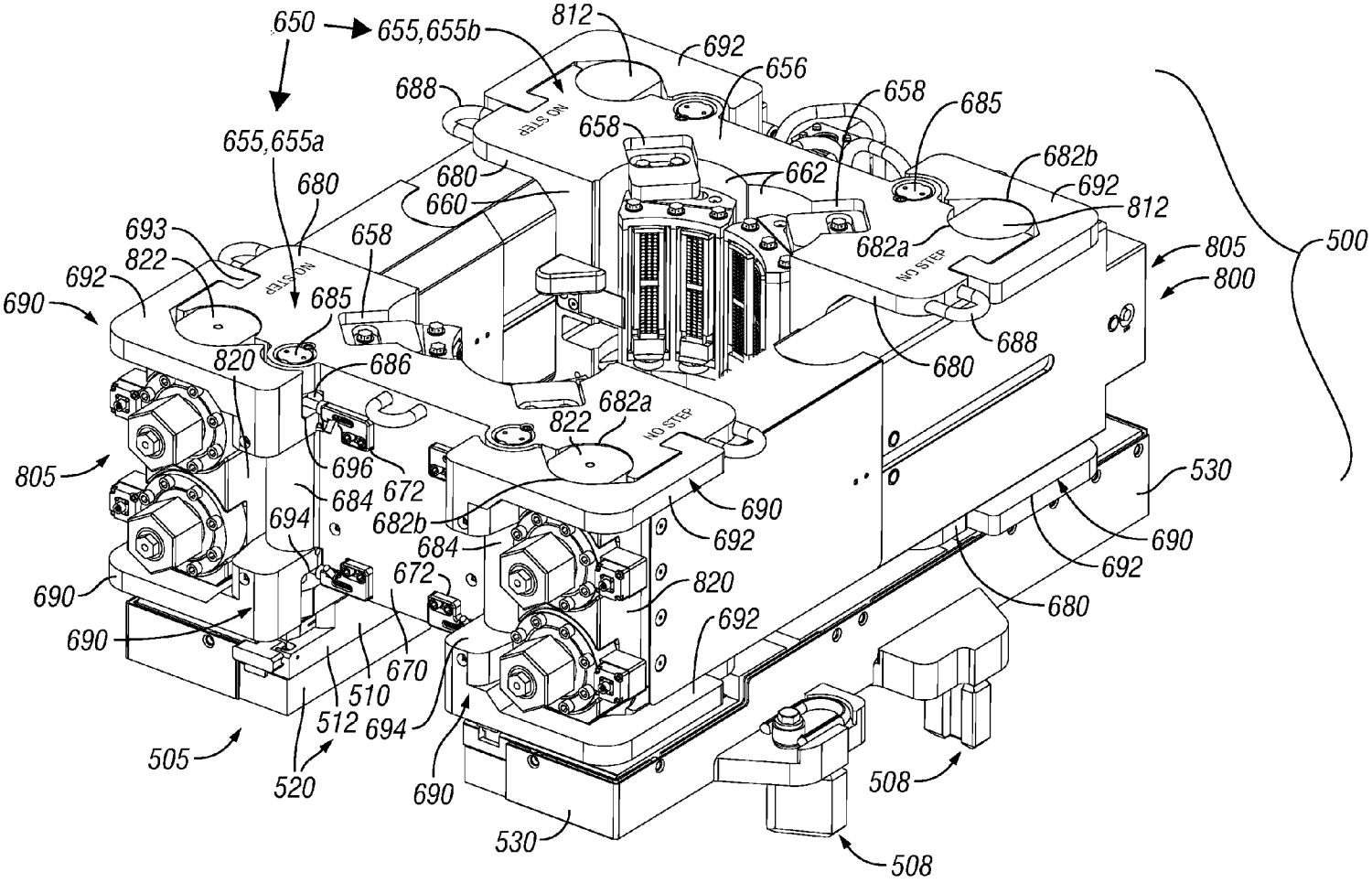
FIG. 10A is a front perspective view of a second embodiment of a clamping device for suspending a well string in accordance with the principles described herein.
Figure 11:
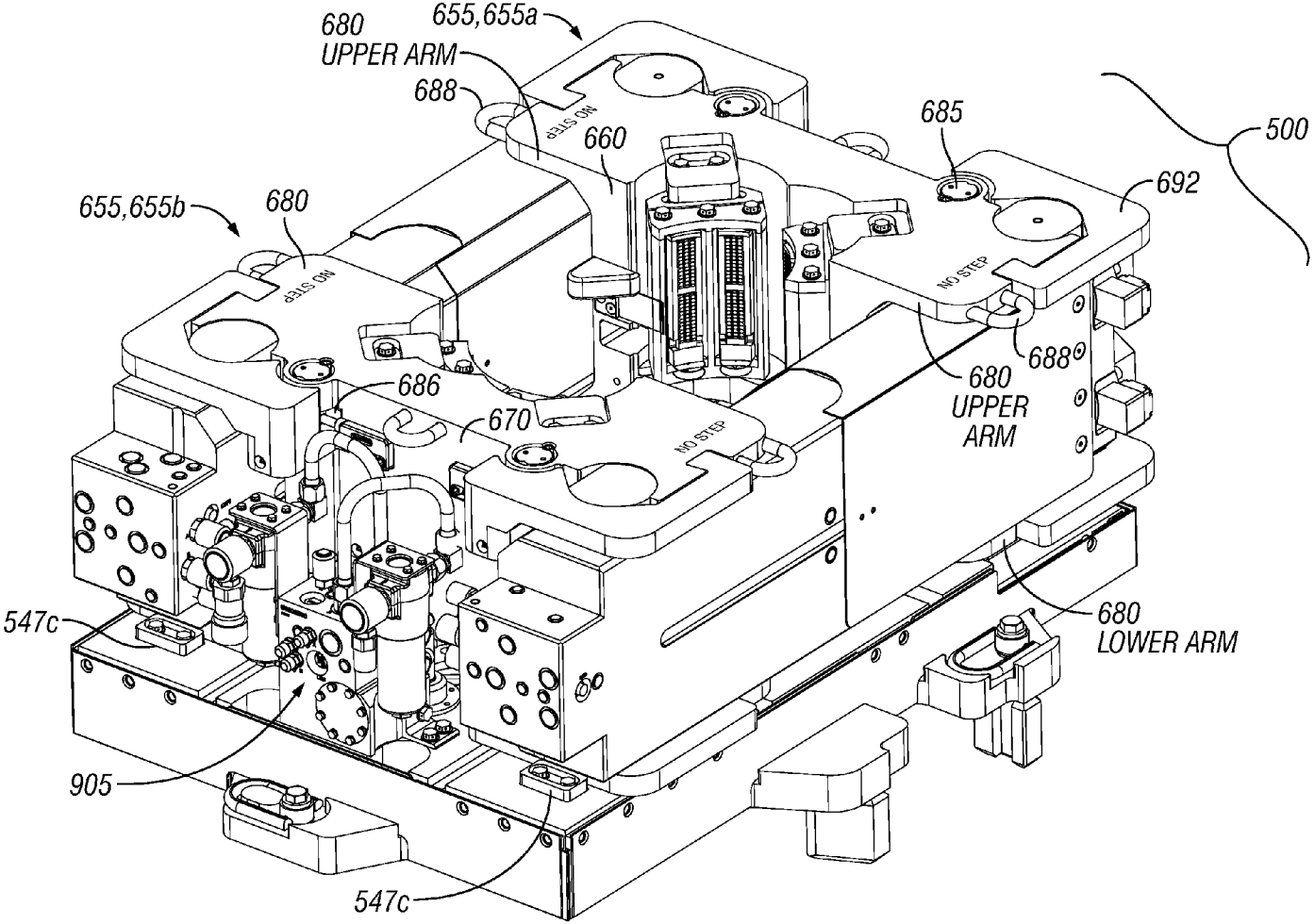
FIG. 11 is a rear perspective view of the clamping device of FIG. 10

FIG. 10A is a front perspective view of a clamping device 500 for supporting components of a downhole well string. FIG. 11 is a rear perspective view of a clamping device 500. Clamping device 500 generally comprises support structure 505, a clamp mechanism 650, and a drive mechanism 800. Drive mechanism 800 operates clamp mechanism 650 to engage or disengage from a component of well string. Support structure 505 couples together clamp mechanism 650 and drive mechanism 800, and supports them and the well string component against a rotary table 338 or the rig floor 314 (FIG. 1), or another receiving structure.

Support Structure

Figure 12:
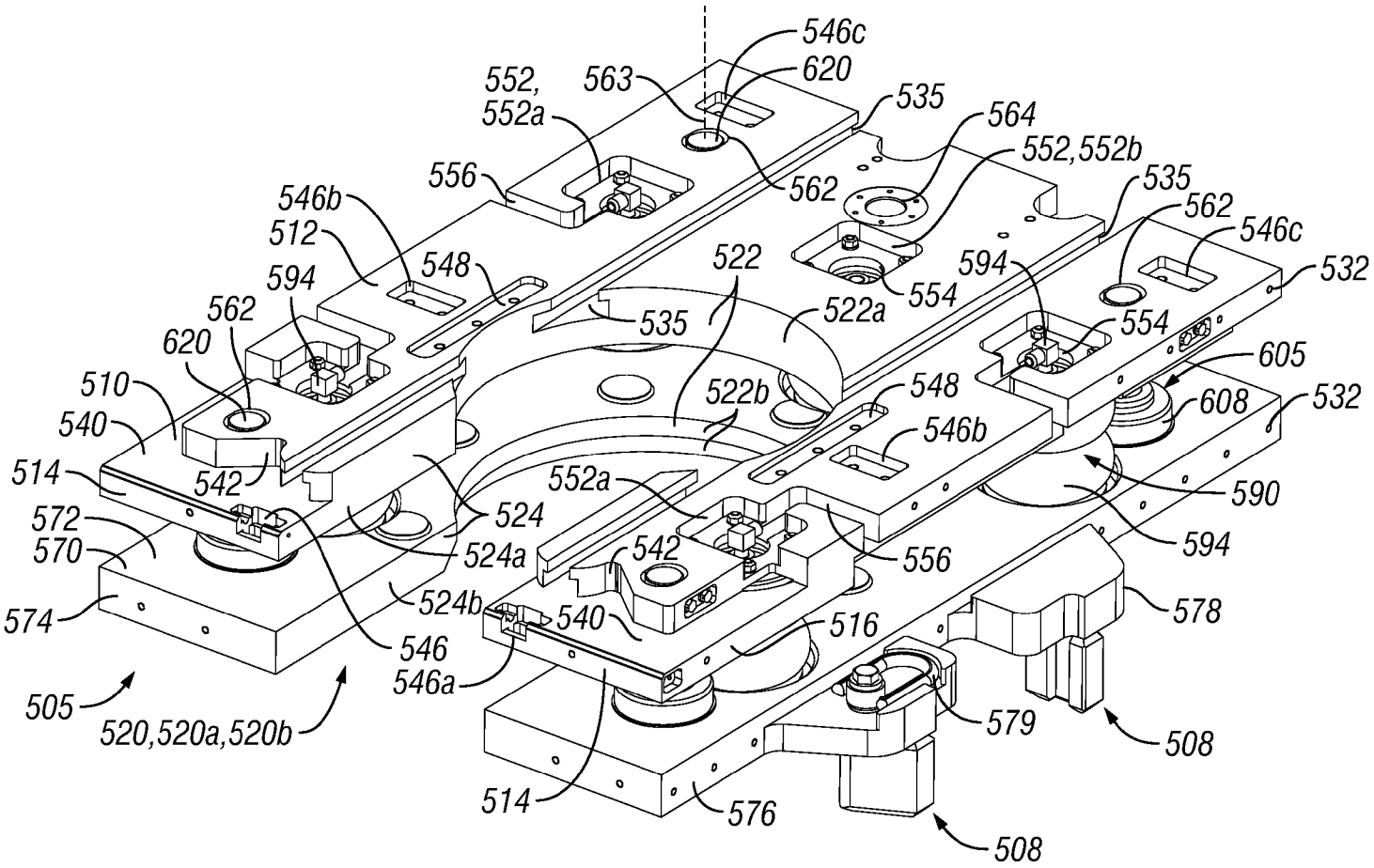
FIG. 12 is a perspective view of the compensator assembly, including first base plate and second base plate, which are components of the clamping device of FIG. 10.

Referring now to FIG. 12, support structure 505 includes a substantially rigid, generally rectangular, upper base plate 510, a substantially rigid, generally rectangular lower base plate 570, a keyhole-shaped slot 520, a plurality of pneumatic bellows 590, a plurality of stroke-limiting base plate guide assemblies 605, and a plurality of adapter lugs 508 attached to and extending downward beyond the bottom surface of the lower base plate 570. Keyhole-shaped slot 520 comprises a central opening 522 and a side opening 524 and extends through the entire support structure 505. Keyhole-shaped slot 520 receives components of a downhole well string. The configuration of keyhole-shaped slot 520 will be described in greater detail below.

Upper Base plate

Referring still to FIG. 12, upper base plate 510 includes a horizontal top surface 512, an outer edge 514 (the front edge), two long outer edges 516, and a keyhole-shaped slot 520*a*. Keyhole-shaped slot 520*a* extends in the direction of the longest dimension of upper base plate 510 and includes a central opening 522*a* and an intersecting a side opening 524*a*. The center 523*a* (FIG. 14) of central opening 522*a* is located at or near the center of upper base plate 510. Central opening 522*a* is contiguous with the side opening 524*a*. Side opening 524*a* runs from the central opening 522*a* to outer edge 514 and divides outer edge 514 into two portions. The diameter of central opening 522*a* is larger than the largest diameter joint to be held by clamping device 500. The top surface 512 includes two T-slots 535, one on each side of side opening 524*a* and running the entire length of upper base plate 510. On top surface 512, two L-shaped recesses 540 are formed near to and including the entire outer edge 514, one on each side of side opening 524*a*. L-shaped recess 540 intersects and thus removes a portion of T-slot 535. Equivalently stated, T-slot 535 terminates into the L-shaped recesses 540. Each L-shaped recess 540 includes a vertical V-shaped indentation 542 near the end of T-slot 535. Together, recess 540 and indentation 543 provide clearance to lower a double-L latch 690 at the bottom of a clamp body 655 before removing clamp body 655. Components 690 and 655 appear in FIG. 10 are described below.

Disposed along all edges of upper base plate 510, e.g. outer edge 514 and outer edge 516 as shown in FIG. 12, are a plurality of small, tapped holes 532 to threadingly engage machine screws used to attach base plate side covers 530 (FIG. 10).

Figure 15:
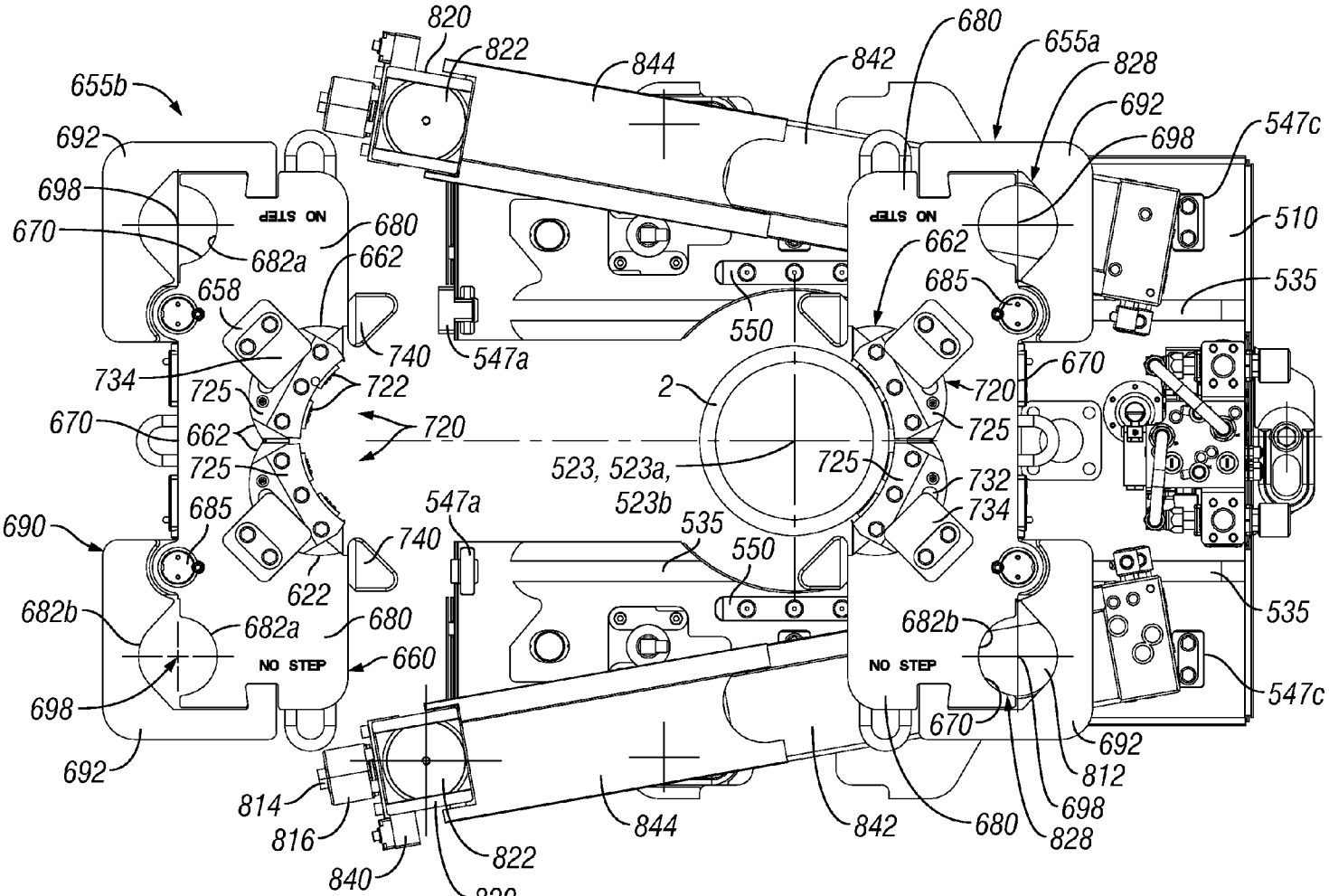
FIG. 15 is a top view of the clamping device of FIG. 10 in stage 2 of the removal mode, in a fully open position.

As best shown in FIG. 12, upper base plate 510 includes additional features for receiving and attaching other members of clamping device 500. On each side of side opening 524*a*, three recesses 546 are formed into surface 512 for receiving end-stops 547, discussed below. End-stop recess 546*a* is disposed along outer edge 514 and in line with T-slots 535. End-stop recess 546*b* is nearly aligned with the center 523 of central opening 522*a* in one direction and is evenly spaced between T-slots 535 and the nearest outer edge 516 in the other direction. End-stop recess 546*c* is disposed near the edge of upper base plate 510 that is opposite outer edge 514. Two slots 548 are formed to matingly receive guide strips 550 (FIG. 15). Guide strips 550 and their slots 548 run parallel to T-slot 535 and are nearly tangent to and lie on opposite sides of central opening 522*a*. The center of each guide strip 550 is aligned with center 523*a* of central opening 522*a*. As such, guide strips 550 are positioned adjacent the region where T-slots 535 intersect central opening 522*a*. Guide strips 550 aid the movement of clamp bodies 655 in the regions where T-slots 535 do not exist and therefore cannot provide guidance.

Continuing with FIG. 12, attachment recesses 552 for pneumatic bellows 590 are a third receiving feature formed in top surface 512. Five such recesses 552 are formed. Within each bellows attachment recess 552, a central hole 554 and four boreholes (not shown) are machined through upper base plate 510 to access and to mount a pneumatic bellows 590. Of the five, four bellows attachment recesses 552*a* are disposed evenly around central opening 522*a* in a rectangular pattern. Each of these four is joined in the middle of one side by an L-shaped channel 556 which is provided for a pneumatic communication line. A fifth bellows attachment recesses 552*b* is formed on the opposite side of central opening 522 from side opening 524*a* and has no channel for air supply. Four oblong holes or slots 562 with central axes 563 (FIG. 17) are disposed near the four exterior corners of upper base plate 510 to receive and attach stroke-limiting base plate guide assemblies 605 (FIG. 19), to be described later. Slots 562 are used instead of round holes the avoid the potential for assemblies 605 to bind while being extended or retracted. Upper base plate 510 further includes borehole 564 and a concentric counterbore 566 for receiving weight sensor 760, which is described below and disposed near the fifth bellows attachment recesses 522*b* on the opposite side from central opening 522*a*.

Lower Base plate

Figure 13:
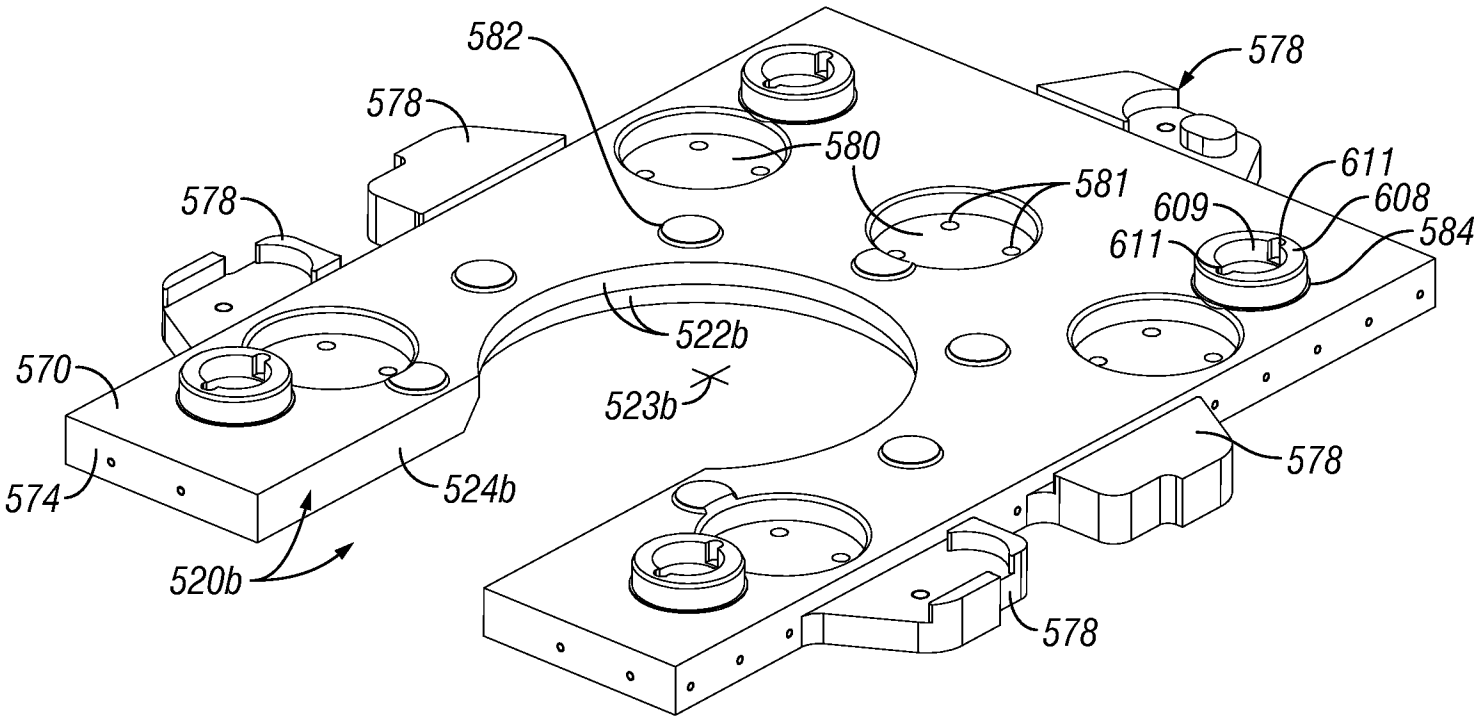
FIG. 13 is a perspective view of the second base plate of the clamping device of FIG. 10.

Referring to FIGS. 12 and 13, the lower base plate 570 is disposed underneath and coupled to upper base plate 510. Lower base plate 570 has a horizontal top surface 572, an outer edge 574 (the front edge), two long outer edges 576, and a keyhole-shaped slot 520*b* extending in the direction of the longest dimension of lower base plate 570. Keyhole-shaped slot 520*b* includes a central opening 522*b* and an intersecting a side opening 524*b*. The center 523*b* of central opening 522*b* is located at or near the center of lower base plate 570. Central opening 522*b* is contiguous with the side opening 524*b*. Side opening 524*b* runs from the central opening 522*b* to outer edge 574 of the lower base plate 570 and divides outer edge 574 into two portions. Central opening 522*b* has a frustoconical shape: it has an upper diameter that matches the diameter of the corresponding central opening 522*a* on upper base plate 510, and a lower diameter that is larger than its upper diameter. In other words, the diameter of central opening 522*b* expands towards the bottom.

Referring still to FIGS. 12 and 13, four adapter wings 578 extend horizontally away from long outer edges 576 and are disposed in a rectangular pattern around central opening 522*b*. A fifth adapter wing 578 extends horizontally away from the center of the edge opposite outer edge 574. Three of the adapter wings 578 have recesses where swinging lifting rings 579 are attached, best shown in FIG. 12. Adapter lugs 508 are attached to the bottom of adapter wings 578 in order to provide a means to engage and transfer force and torque to a receiving structure, such as rotary table 338, power slips, or other such supporting structure.

Focusing now on FIG. 13, the lower base plate 570 includes five bellows-receiving counterbores 580 that are axially aligned with the corresponding central holes 554 in the upper base plate 510. Each counterbore 580 has four circumferentially positioned, evenly spaced stud boreholes 581 to receive studs for retaining bellows 590. Four guide cylinder boreholes 584 are disposed in lower base plate 570 and are axially aligned with the corresponding central axes 563 of slots 562 in the upper base plate 510. In addition, a plurality of short cylindrical protrusions 582 are circumferentially disposed about central opening 522*b* on top surface 572. These cylindrical protrusions 582 mate with counter bore holes (not shown) in the bottom surface of upper base plate 510 and stabilize upper base plate 510 against horizontal translation when clamping device 500 supports the weight of a well string component, such as pipe joint 2.

Pneumatic Bellows and Guide Assemblies

Again referring to FIG. 12, a plurality of pneumatic bellows 590 and a plurality of stroke-limiting base plate guide assemblies 605 couple and support upper base plate 510 above lower base plate 570. Pneumatic bellows 590 give a visual indication of when clamping device 500 is and is not supporting the weight of a well string 330. This visual indication is a safety feature. When the weight of a well string 330 is applied to clamping device 500, pressure in pneumatic bellows 590 increases. Then, bellows 590 are relieved of air through exhaust relief valves (not shown), and bellows 590 compress. Upper base plate 510 settles on to lower base plate 570 as shown in FIG. 20. When weight is removed from clamping device 500, by drawworks 320 (FIG. 1), pneumatic bellows 590 expand and upper base plate 510 rises to the configuration shown in FIG. 19. Concurrently, guide assemblies 605 limit the stroke, i.e. distance of vertical travel, and reduce the horizontal motion of upper base plate 510 as weight of a well string is added to, or taken from, clamping device 500.

In clamping device 500, there are five pneumatic bellows 590 that are mounted at their bottom end in the appropriate counterbores 580 and at their top end in the attachment recesses 522 as described with reference to FIGS. 12 and 13. In the embodiment shown, pneumatic bellows 590 includes two air pockets, however, bellows having a greater or fewer number of air pockets may be employed. Pneumatic bellows 590 has a circular base plate with four studs for engagement with counterbores 580 in lower base plate 570. The studs pass through boreholes 581 in lower base plate 570 to be threadingly engaged with nuts (not shown). At the top end, pneumatic bellows 590 has studs that pass through upper base plate 510 and are threadingly engaged and held by nuts (not shown) within bellows attachment recess 552. Bellows 590 may be fastened by other means as well. Also within bellows attachment recess 552, a ninety-degree elbow pneumatic coupling 594 attaches at one end to pneumatic bellows 590 through central hole 554. The other end of pneumatic coupling 594 faces the L-shaped channel 556 for attachment to a pneumatic air line (not shown).

Figure 19:
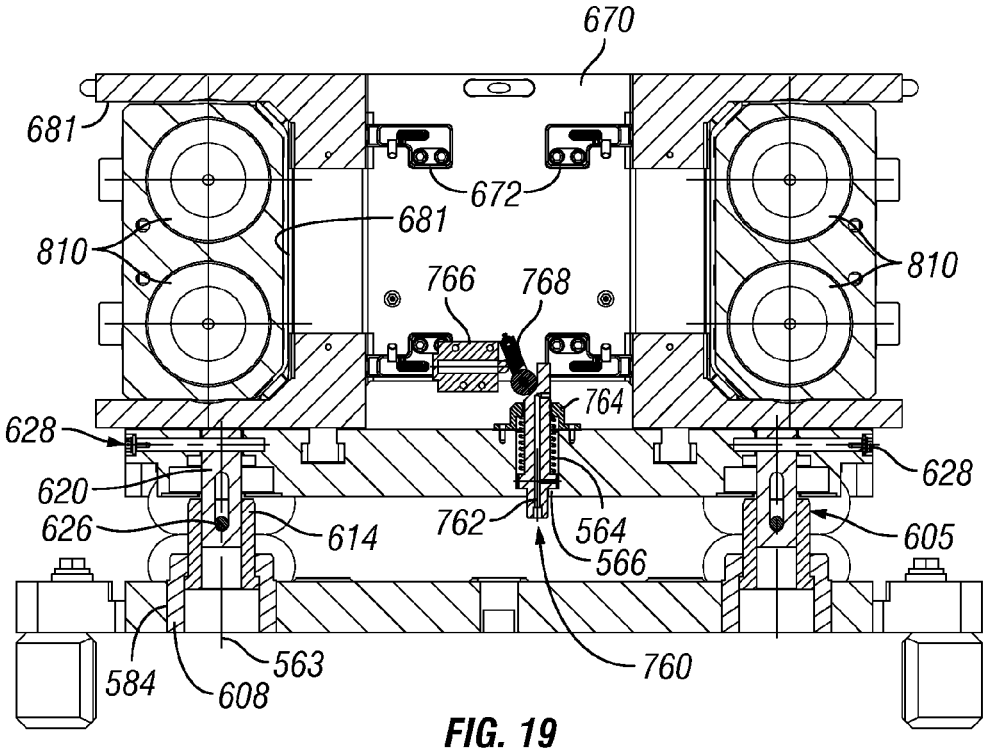
FIG. 19 is a sectional end view of the clamping device of FIG. 10 when the clamping device is not supporting the weight of the well string, taken along line 19-19 shown in FIG. 17.
Figure 20:
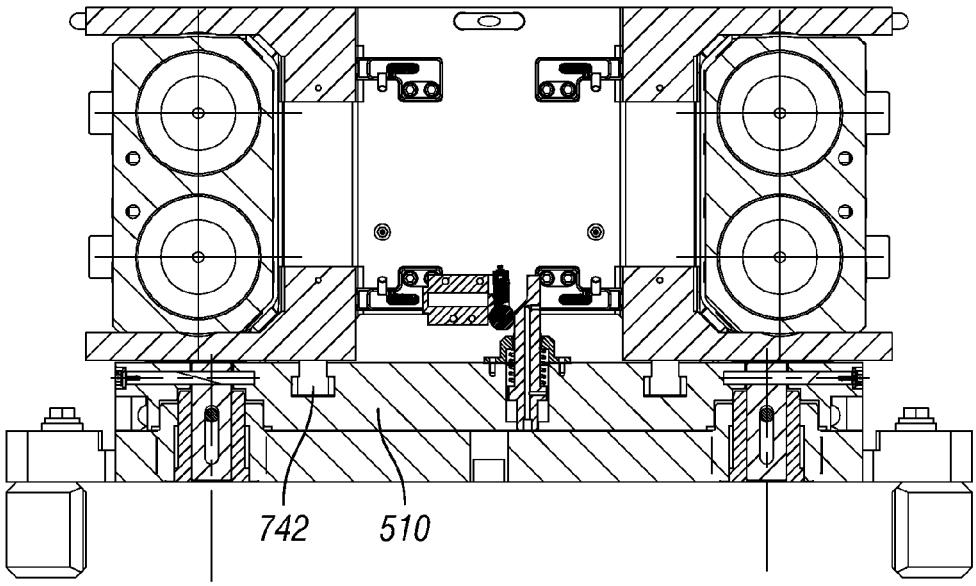
FIG. 20 is a sectional end view of the clamping device of FIG. 10 when the clamping device is supporting the weight of the well string, taken along line 19-19 shown in FIG. 17.
Figure 24:
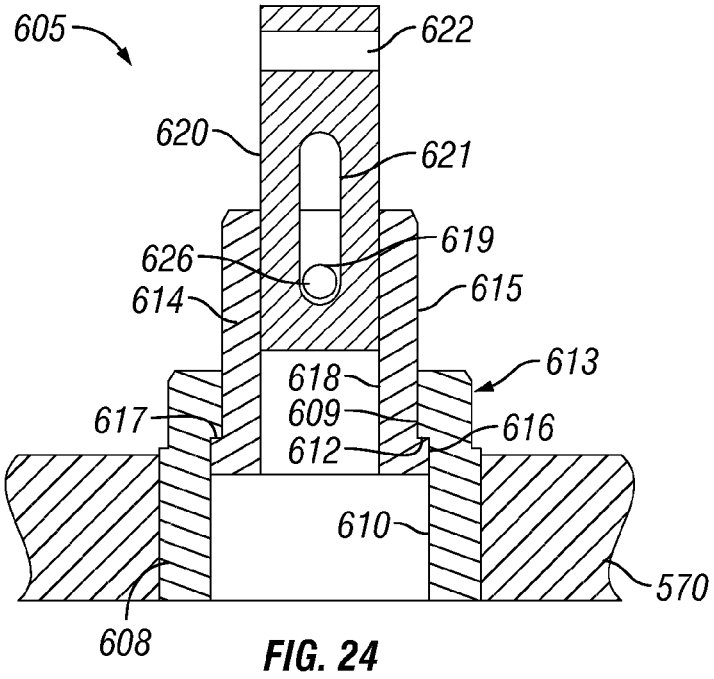
FIG. 24 is an enlarged, cross-sectional view of a stroke-limiting base plate guide assembly shown in FIG. 19.

As shown in FIGS. 19 and 24, guide assembly 605 is a series of axially aligned cylinders that telescopingly extend and, alternately, collapse as upper base plate 510 rises and settles under the load of drill string 330. Better seen in FIG. 24, guide assembly 605 comprises a lower guide sleeve 608, a middle guide sleeve 614, an upper guide rod 620, and a stroke-limiting pin 626. Lower guide sleeve 608 has an upper borehole 609 and a lower counter bore 610, leaving an internal, circular ledge 612 facing downwards. At the top of guide cylinder 608, a pin groove 611 (FIG. 13) is disposed perpendicular to and extending across the central axis of guide cylinder 608. Middle guide sleeve 614 has first outer diameter 615 defining a majority of the outer surface and a larger, second outer diameter 616 confined to a small bottom section. The differing diameters 615 and 617 create an upward-facing external circular ledge 617 that contacts internal circular ledge 612 and limits the extent of vertical motion when the guide assembly 605 extends. Middle guide sleeve 614 also has an axial borehole 618 and a radially-aligned pin hole 619 passing horizontally through its sidewall to receive stroke-limiting pin 626. The upper guide rod 620 glidingly engages inside borehole 618 of middle guide sleeve 614. Upper guide rod 620 has a radially-aligned pin slot 612 to receive stroke-limiting pin 626. Upper guide rod 620 further has a radially-aligned crossbore 622 to receive guide rod retainer pin 628 and bind with upper base plate 510 (FIG. 19). How the components of the guide assembly 605 are assembled and the relative sizes of the various components are best shown in FIG. 24. Predominantly, stroke-limiting pin 626 passes through middle guide sleeve 614 and upper guide rod 620 to limit the upward extension of guide assembly 605.

Clamping device 500 incorporates four guide assemblies 605 mounted at their upper end in the slots 562 in upper base plate 510. The lower guide sleeves 608 are attached inside guide cylinder boreholes 584 and extend beyond top surface 572 of lower base plate 570. The upper, extended portion of each lower guide sleeves 608 has an upper, outer diameter 613 that is less than the inner diameter of borehole 584 but matches a corresponding recess (not shown) in the bottom of upper base plate 510. Each corresponding recess in the bottom of plate 510 is round and shares a central axis 563 with a mating slot 562.

Clamp Mechanism of the Second Embodiment of the Clamping Device

Figure 18:
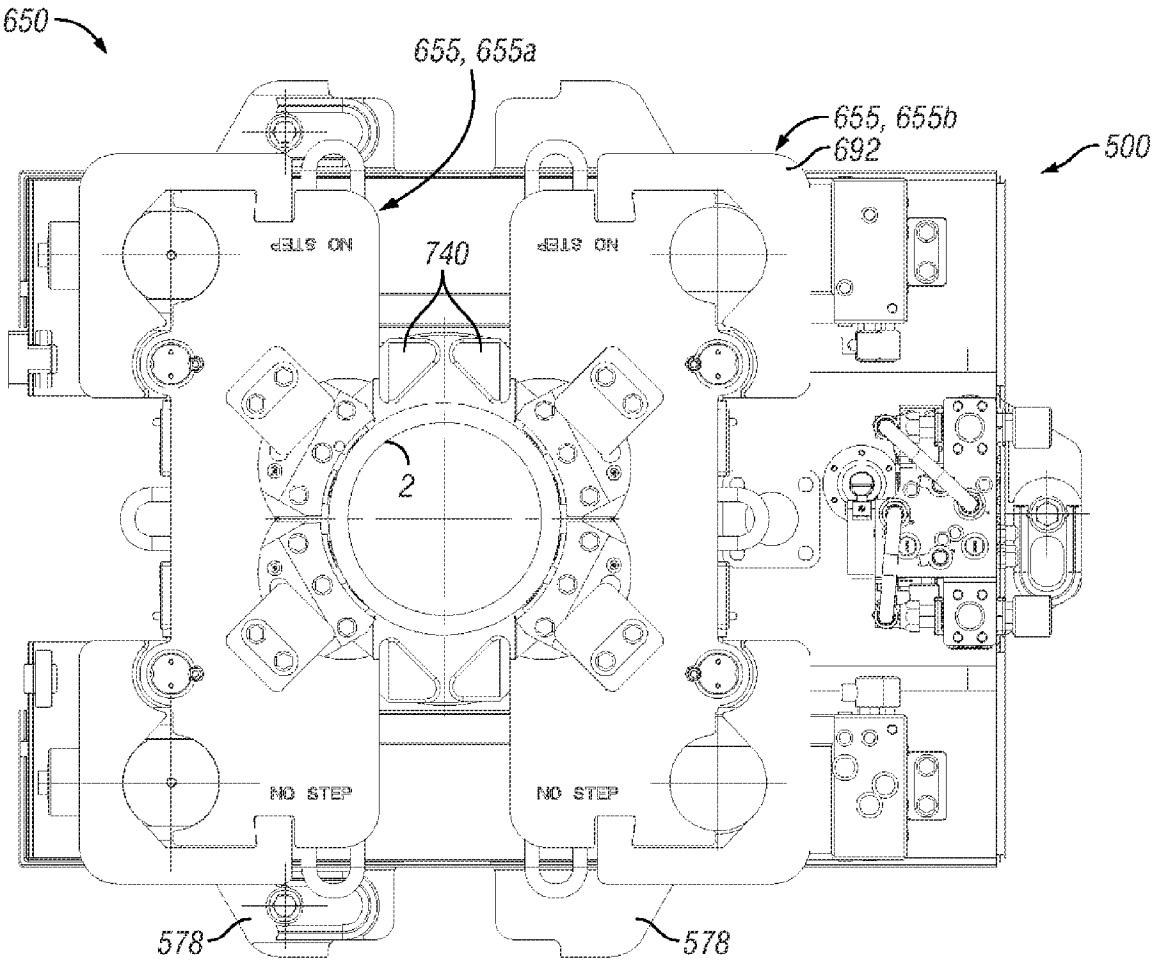
FIG. 18 is a top view of the clamping device of FIG. 10 in operationally-closed position.

Referring to FIG. 18, clamp mechanism 650 comprises two opposing clamp bodies 655 that are moved toward one another to engage and suspend a well string component (e.g., joint 2) within central opening 522. Referring to FIG. 10, clamp mechanism 650 is slidably mounted on top surface 512 of upper base plate 510. Clamp mechanism 650 has two similar clamp bodies 655. First or front clamp body 655*a* spans across side opening 524 and faces central opening 522 of the keyhole-shaped slot 520 in support structure 505. Second or rear clamp body 655*b* is positioned on the opposite side of central opening 522. Rear clamp body 655*b* is turned the opposite direction of front clamp body 655*a* and thereby also faces central opening 522. Clamp bodies 655*a*, 655*b* include gripping die inserts 722 that engage joint 2. Clamp bodies 655*a*, 655*b* are held and controlled by drive mechanism 800 and move parallel to top surface 512.

Referring to FIGS. 10 and 15, each clamp body 655 has a generally rectangular shape and includes two pair of horizontally disposed arms 680. Each pair of arms 680 includes an upper and lower arm. Each pair of arms 680 forms a generally rectangular recesses 681 (best shown in FIG. 19) on outwardly-facing ends of clamp body 655 to receive components of drive mechanism 800 as discussed more-fully below. Clamp body 655 also includes a top face 656, an internal face 660 facing generally towards central opening 522, an external face 670, and two vertical shafts 685.

Figure 21:
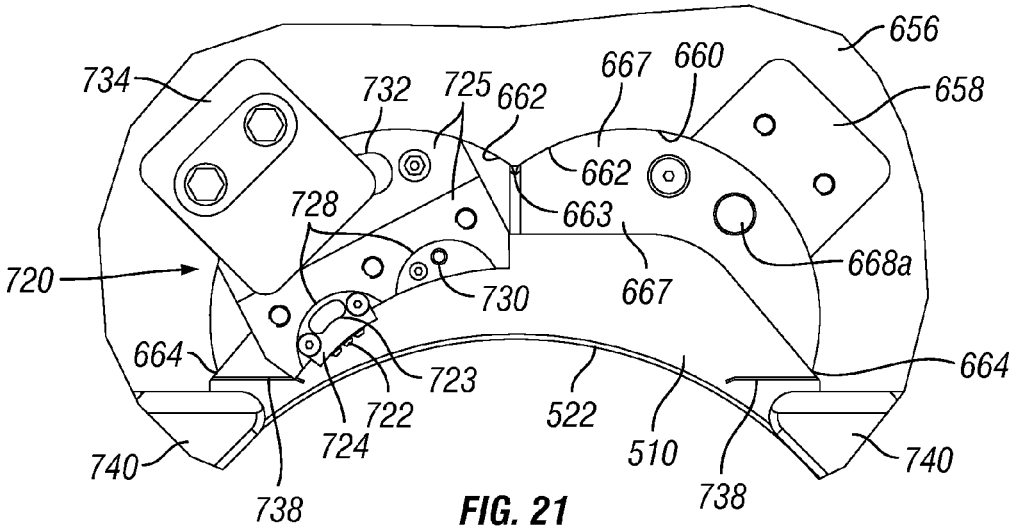
FIG. 21 is a top breakout view of a clamping body with a partially assembled insert carrier and one die insert for the clamping device of FIG. 10.

Referring to FIGS. 15 and 21, the internal face 660 includes flat regions and two concave vertically-extending surfaces 662 that share a common central edge 663 in the middle of internal face 660. As seen in top view of FIG. 21, the concave vertically-extending surfaces 662 partially face towards each other, and partially face towards central opening 522. Surfaces 662 begin at top face 656 and extend almost down to the bottom of clamp body 655, leaving a centrally located bottom ledge 667, best shown in FIG. 21 and also shown in the elevation view of FIG. 22. A short, vertically-oriented carrier-retaining pin 668 (FIG. 21) is coupled with and extends above bottom ledge 667. The horizontal distance from the common central edge 663 to the carrier-retaining pin 668 is greater than the distance from carrier-retaining pin 668 to the outer vertical edge 664 of concave, vertical surface 662.

Referring back to FIG. 10A, upper arms 680 of clamp body 655 are flush or coplanar with top face 656 and are horizontal metal plates extending outwardly and away from side opening 524*a*. Lower arms 680 are similar but are coplanar or flush with the bottom of clamp body 655. The lower and upper arms 680 of clamp body 655 extend towards the outer edges 516 of upper base plate 510. On one side, lower and upper arms 680 define a narrow portion of the external face 670 of clamp body 655. Face 670 includes nearly semi-circular grooves 682*a* which are defined in part by a vertical central axis 698 (FIG. 15).

As best shown in FIG. 10, the top face 656 of clamp body 655 has rectangular recesses 658 that are adjacent to the upper edges of concave, vertical surfaces 662.

Figure 10B:
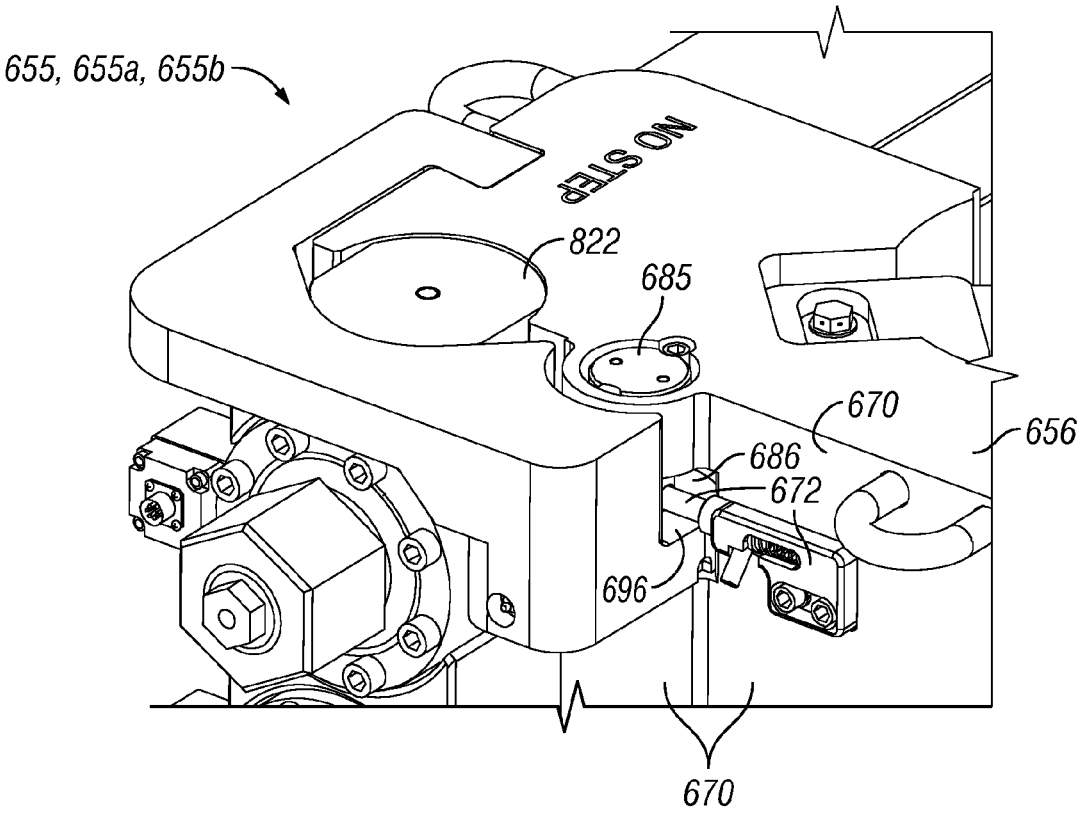
FIG. 10B is an enlarged view of the double L latch, part of clamping device shown in FIG. 10A.

Referring still to FIG. 10, vertical shafts 685 are imbedded within clamp body 655 generally above T-slots 535 in upper base plate 510. Vertical shafts 685 are positioned sufficiently near external face 670 so that external face 670 includes a outward curved protrusions. Referring now from FIG. 10*a* to FIG. 10*b*, a small latch clearance slot 686 is disposed in clamp body 655 intersecting external face 670 below top face 656. Latch clearance slot 686 leaves a gap around a portion of vertical shaft 685. In all, four latch clearance slots 686 are so disposed in both upper and both lower corners of clamp body 685. Each slot 686 slidingly receives a double-L latch 690. Latch members 690 provide clearance for cylinder assembly 805 to wing laterally away from the clamp body 655 that spans side opening 524, as described below. The latch clearance slots 686 are sufficiently long to allow a mating member of a double-L latch 690 enough space to slide vertically. Four sliding locks 672 are mounted on external face 670. The shafts of sliding locks 672 move horizontally and are aligned with and are received by the four latch clearance slots 686 in the two vertical shafts 685 on clamp body 655.

Referring again to FIG. 10, double-L latch 690 disposed on the upper, outer corners of clamp body 655 matingly receives and couples pull block 820 of the cylinder assembly 805. Double-L latch 690 moves vertically away from clamp body 655 in order to provide the clearance before removing a cylinder assembly 805 from clamp body 655. Double-L latch 690 is formed to have two L-shaped arms 692, 694, each lying in a plane perpendicular to the other and joined at the top end of each "L." A large L-shaped arm 692 lies parallel to and near top face 656 and is generally positioned to extend beyond external face 670. However, the "foot" portion of the large L-shaped arm 692 extends back, along the side of adjacent lower or upper arm 680 of clamp body 655 and includes a rectangular protrusion 693 that reaches into a cut in the middle of lower or upper arm 680. The top of the "L" of the large L-shaped arm 692 is positioned near the top of vertical shaft 685. The upper end of small L-shaped arm 694 starts at this same location and extends generally vertically, with the "foot" or lower portion of the small "L" reaching towards external face 670 clamp body 655 and extending into latch clearance slot 686 around vertical shaft 685. The vertical shaft 685 slidingly couples with a vertical borehole in the lower portion of the small L-shaped arm 694. Latch clearance slot 686 is large enough to have an open gap even after vertical shaft 685 receives the small L-shaped. This gap of latch clearance slot 686 allows the entire double-L latch 690 to be raised and lowered to couple and decouple clamp body 655 from cylinder assembly 805. For a double-L latch 690 disposed at the bottom of clamp body 655, the directions of travel for to coupling and decoupling are reversed. In order to couple with cylinder assembly 805, the large L-shaped arm 692 of each double-L latch 690 has a semi-circular groove 682*b*, which shares the vertical central axis 698 with semi-circular groove 682*a* of the adjacent lower or upper arm 680. Together, semi-circular grooves 682*a* and 682*b* form a generally circular hole that receives cylindrical stud 822 on pull-block 820 of cylinder assembly 805.

Pivotable Gripping Devices of the Second Embodiment of the Clamping Device

Figure 22:
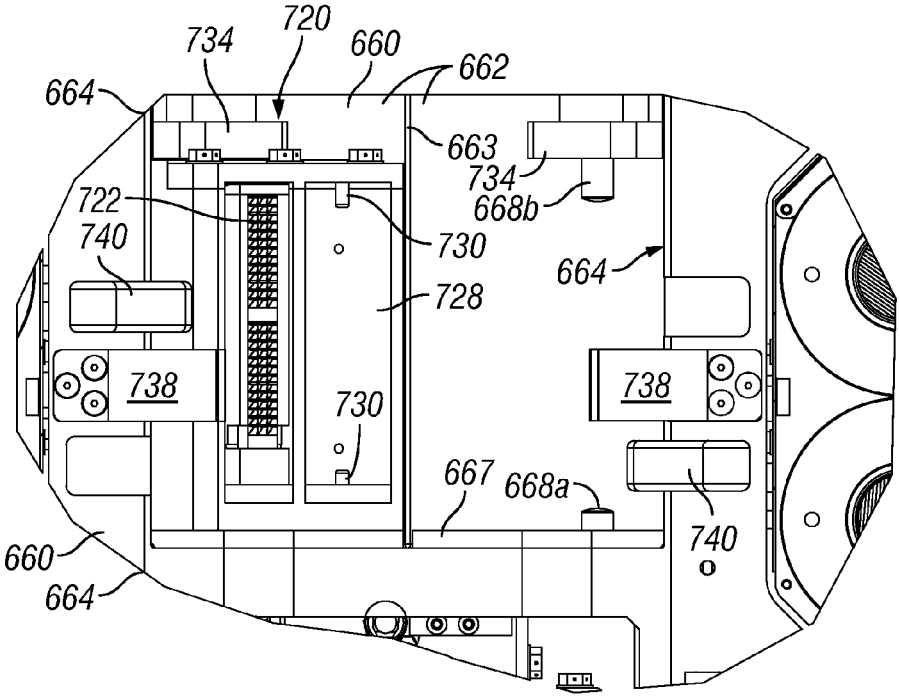
FIG. 22 is a front breakout view of a clamping body with a partially assembled insert carrier and one die insert for the clamping device of FIG. 10.

The gripping capability of clamping device 500 is now described with reference first to FIGS. 15, 21, and 22. Each clamp body 655 is coupled to a plurality of pivotable gripping devices 720 at concave vertical surfaces 662 and at rectangular recesses 658. Each die retention device 720 comprises a plurality of die inserts 722, a plurality of pivotable die insert holders 724, a plurality of holder-retaining pins 730, an insert carrier 725, a plurality of carrier-retaining pins 668, and a retaining plate 734. These will be described, generally, in the reverse order.

Each insert carrier 725 generally faces and is generally circumferentially aligned with central opening 522 in support structure 505. The convex back surface of insert carrier 725 conforms and slidingly mates with the concave, vertical surface 622 on a clamp body 655. Both ends of insert carrier 725 have a curved vertical slot 732 that matingly receives a carrier-retaining pin 668. Therefore, each insert carrier 725 is coupled by two carrier-retaining pins 668 in this embodiment. As previously described, one of these carrier-retaining pins 668*a* is coupled with and extends above bottom ledge 667. The other carrier-retaining pin 668*b* (FIG. 22) is coupled with and extends down from one portion a retaining plate 734. The opposite end, at retaining plate 734, is attached inside rectangular recesses 658 below the top face 656 of clamp body 655. Furthermore, the width, length, and curvature of curved vertical slot 732 allow insert carrier 725 to pivot on carrier-retaining pins 668 and slide along concave, vertical surfaces 662. In this manner, insert carrier 725 is held by and coupled to clamp body 655.

In a similar manner, insert carrier 725 slidably and pivotally couples with a plurality of die insert holders 724. To facilitate this arrangement, insert carrier 725 has a plurality of concave, vertical channels 728 that face opening 522. The convex back surface of a die insert holder 724 conforms to and is mounted against concave, vertical channel 728. Both ends of die insert holder 724 have a curved vertical slot 723 that matingly receives a holder-retaining pin 730 from insert carrier 725. The width, length, and curvature of curved vertical slot 723 allow die insert holder 724 to pivot on holder-retaining pins 730 and to slide against vertical channel 728. Each die insert holder 724 holds and couples a plurality of die insert 722 which, in turn, have toothed surfaces to grip the circumference of joint 2.

The described features of pivotable gripping device 720 and the complementarily concave, vertical surfaces 622 incorporated within clamp body 655 allow the orientation of die inserts 722 to adjust automatically to the curved surfaces of joint 2 if joint 2 falls within a prescribed range of diameters. On each clamp body 655, a plurality of leaf springs 738 are mounted on internal face 660 such that a free end extends beyond outer vertical edges 664 of concave, vertical surfaces 662. The free end of each leaf spring 738 presses against an insert carrier 725, pushing or biasing it towards common central edge 663 of concave, vertical surfaces 662. When clamping device 500 is not engaging joint 2, the two adjacent insert carriers 725 are pushed together near common central edge 663. As joint 2 is gripped, the compressive force pushing against die inserts 722 causes die insert holders 724 to slide and pivot along concave, vertical channels 728 and also causes the insert carriers to slide and pivot along concave, vertical surfaces 662 until the compressive force is more evenly distributed across all gripping surfaces, i.e. all die inserts. In this manner, the pivotable gripping devices 720 automatically adjust to the particular diameter of the joint 2 disposed within the clamping mechanism 650 of clamping device 500.

Weight Sensor on the Second Embodiment of the Clamping Device

Referring to FIG. 19, a weight sensor 760 indicates when clamping device 550 is supporting the weight of a joint 2 or other well string component. Weight sensor 760 comprises a spring-loaded contact pin 762, a retainer cap, a position switch 766 with hydraulic channels, and wheel and lever assembly 768. The spring-loaded contact pin 762 slidably mates with the vertical recess formed by borehole 564 and counterbore 566 in upper base plate 510 and extends above and below upper base plate 510. The spring-loaded contact pin 762 is held within upper base plate 510 by a retainer cap 764. The upper portion of spring-loaded contact pin 762 is tapered and contacts wheel and lever assembly 768 that is rotatably coupled with a proximity switch that is attached to the exterior face 670 of second clamp body 655*b*. When grasped by clamp mechanism 650, the weight of a joint 2, causes the air in the pneumatic bellows 590 to be relieved (released) through a pressure relief valve (not show). Consequently, all bellows 590 compress, and upper base plate 510 rests on lower base plate 570. This action causes contact pin 762 to rise relative to upper base plate 510, the second clamp body 655*b*, the position switch 766, and wheel and lever assembly 768. As a result, the tappered end of contact pin 762 pushes the wheel and lever assembly 768 towards position switch 766 to alter the configuration of fluid channels in switch 766 and control the behavior of clamping device 500, as described later with the drive control system 900. In another embodiment, position switch 766 could be coupled with a similar electric position switch so that a signal could also be sent to the control system and user interface 312. When the weight is released from clamping device 550, the pneumatic bellows re-inflate with air supplied through pneumatic coupling 594, and upper base plate 510 rises, allowing the contact pin 762 to fall and to cease pressing wheel and lever assembly 768 against position switch 766, cancelling the weight signal.

Drive Mechanism of the Second Embodiment of the Clamping Device

Figure 17:
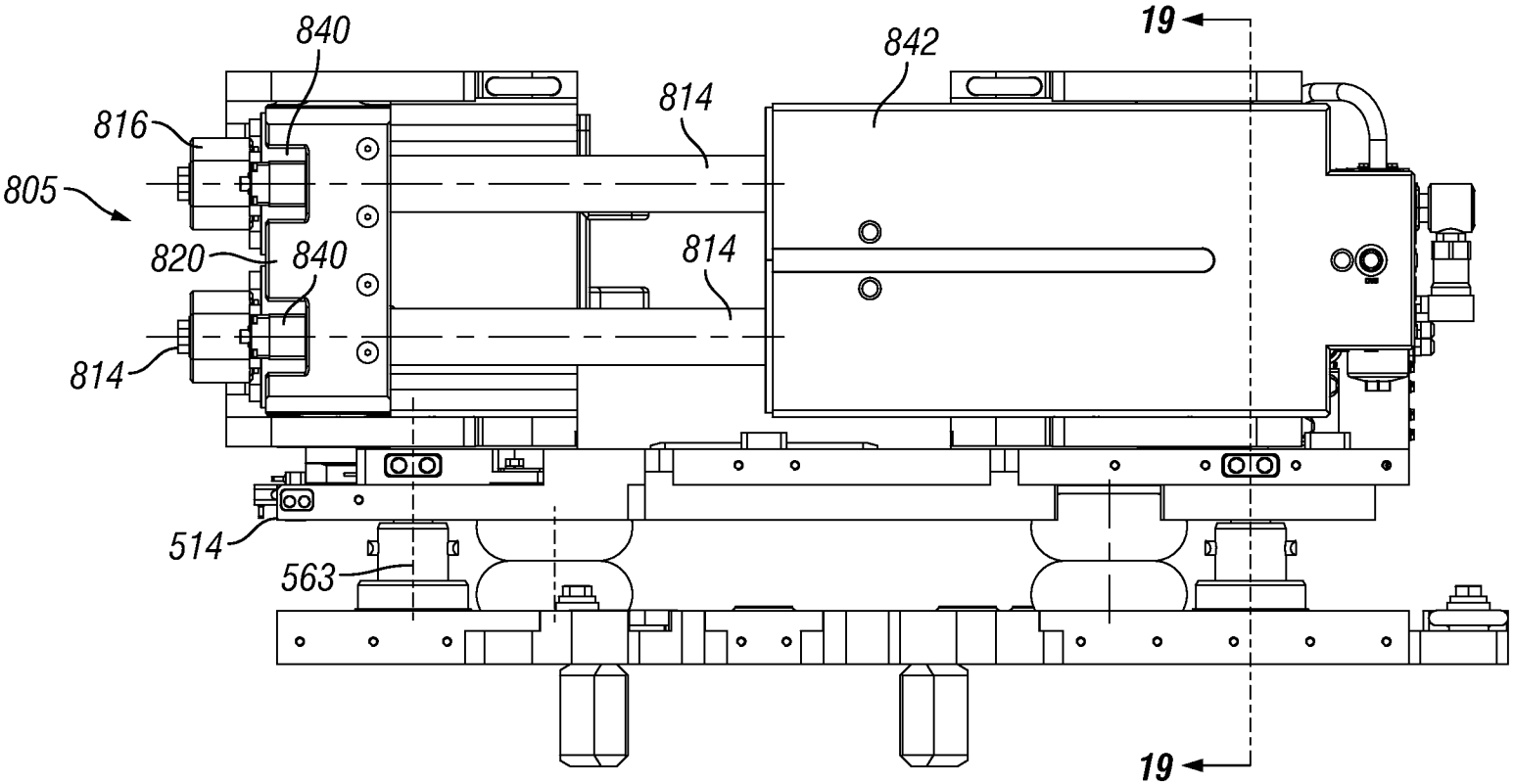
FIG. 17 is a side view of the clamping device of FIG. 10 in an operationally-open position.
Figure 25:
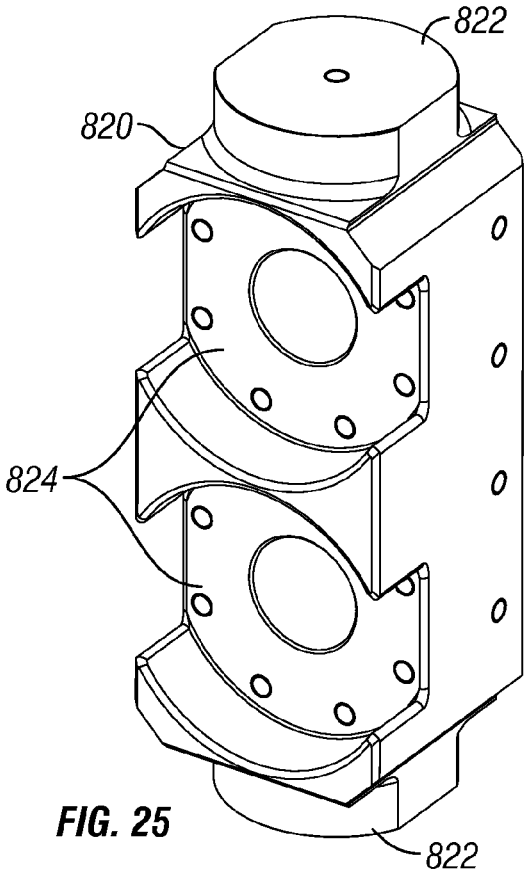
FIG. 25 is a perspective view of a pull-block used to join fluid powered cylinders with clamp bodies in the clamping device of FIG. 10.

Referring to FIGS. 10, 15, and 17, drive mechanism 800 comprises a plurality of cylinder assemblies 805. In this embodiment, each cylinder assembly 805 comprises one or more of fluid powered cylinders 810, one or more pull-blocks 820, a load cell 840 for each cylinder 810, and cylinder covers 842 and 844. During most operations, cylinder assembly 805 lies parallel to side opening 524 of the key-hole shaped slot 520. The front end of cylinder assembly 805 lies near the outer or front edge 514 of upper base plate 510. Pull-block 820 is positioned at the front end of cylinder assembly 805. As shown in FIG. 25, pull-block 820 is a generally rectangular block with its longest dimension disposed vertically. Generally-cylindrical studs 822 are positioned at the top and bottom of pull-block 820. The front face of pull-block 820 has a plurality of combination holes 824 (two are shown) formed by a borehole that receives the threaded rod-end of fluid powered cylinder 810 and a counter bore that receives a load cell 840. The rear vertical face (not shown) of pull-block 820 is flat. The assemblage of these components is shown in FIG. 17.

Referring now to FIG. 17, at the rear or back end of cylinder assemblies 805, cylinder inner cover 842 surrounds the cap-end of fluid powered cylinder 810. At the front end, cylinder rod 814 extends toward and beyond front edge 514. In this region, cylinder rod 814 is coupled with pull-block 820 and load cell 840, as previously indicated. A large nut and washer 816 threadlingly engages the end of cylinder rod 814, tightly coupling load cell 840 and pull-block 820 on cylinder rod 814. As seen in several views, such as FIGS. 10 and 15, a cylinder outer cover 844 is disposed around the cylinder rod 814 and is attached to pull-block 820. Outer cover 844 slides over the outside of inner cover 842 as fluid powered cylinder 810 expands and retracts.

Figure 16:
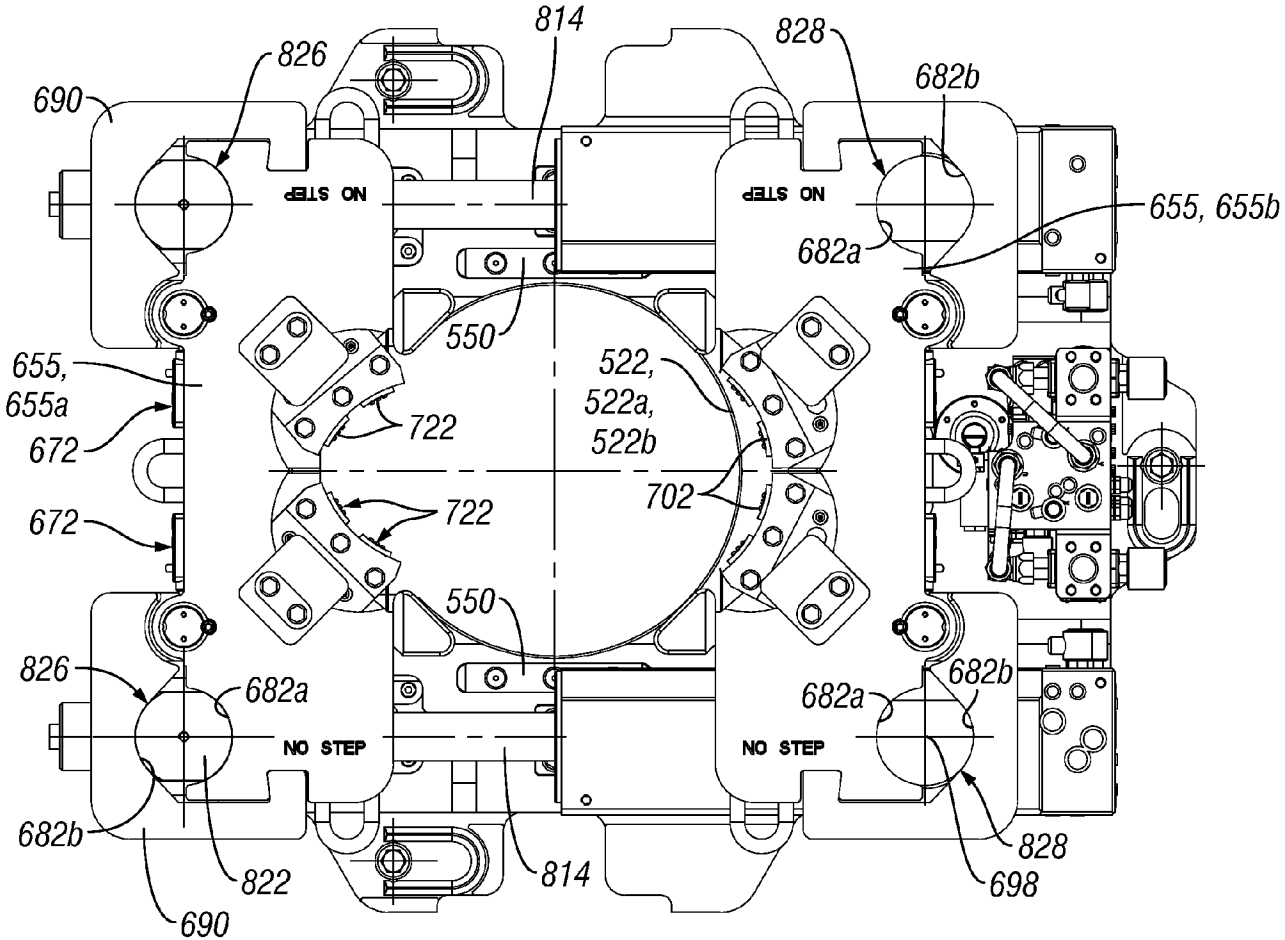
FIG. 16 is a top view of the clamping device of FIG. 10 in an operationally-open position.

Shown in FIG. 16, studs 822 of pull-block 820 couple with semi-circular grooves 682*a*, 682*b* on front clamp body 655*a* to form upper and lower detachable front joints 826. Front joints 826 couple cylinder assembly 805 with front clamp body 655*a*. At the other end of cylinder assembly 805, the end furthest from front edge 514, cylindrical studs 812 engage the upper and lower surfaces of cylinder assembly 805. More specifically, studs 812 couple with semi-circular grooves 682*a*, 682*b* on rear clamp body 655*b* to form upper and lower pivoting rear joints 828. Rear joints 828 couple cylinder assemblies 805 with front clamp body 655*b*.

Drive Control System of the Second Embodiment of the Clamping Device

Figure 23:
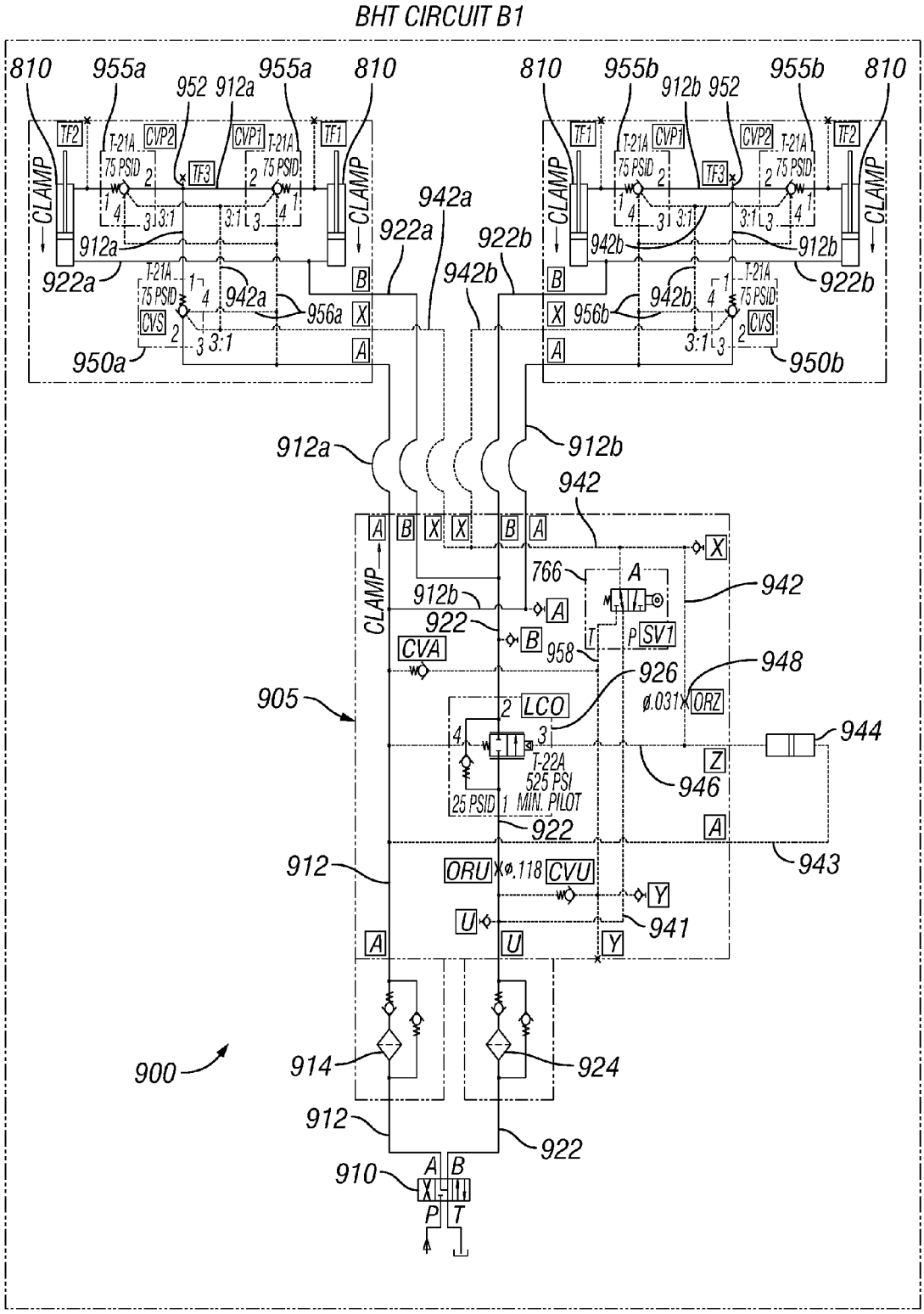
FIG. 23 is a schematic of a drive control system for controlling operation of the clamping device of FIG. 10.

FIG. 23 presents a schematic of drive control system 900, which comprises directional control valve 910, fluid lines 912, 912*a*, 912*b* communicating with the rod-ends of cylinders 810, fluid lines 922, 922*a*, 922*b* communicating with the cap-ends of cylinders 810, sequence valve 926, position switch 766 (introduced earlier), pilot (signal) lines 942, 942*a*, 942*b*, time-delay cylinder 944, check valves 950 and 955, and other supporting components. Check valves 950 and 955 are local to the cylinder assemblies 805. Check valves 950 and 955 are piloted to receive a pressure signal to command the valve to allow reverse flow when required. Each fluid powered cylinder 810 has a cylinder safety check valve 955 to insure that fluid pressure in rod-end of the cylinder is not lost in the event of power loss. Cylinder assembly 805 includes a plurality of cylinders 810 (e.g. two as described in this embodiment). For each cylinder assembly 805, a secondary safety check valves 950 is plumbed in series with a T-coupling 952 that connects the two safety check valves 955 from adjacent cylinders 810.

Several of the other components of drive control system 900 are mounted in a control manifold 905 (FIGS. 11 and 23). The drive control system 900 receives power from a pump (not shown) or another means of pressurized hydraulic fluid. Fluid is received and returned via directional control valve 910, shown at the bottom of FIG. 23. Valve 910 sets the direction of travel of cylinders 810 by adjusting the direction of fluid flow appropriately. When cylinders 810 are to be retracted to draw the two clamp bodies 655*a* and 655*b* together, pressurized fluid is directed to fluid lines 912 that communicate with the rod-ends of cylinders 810. Fluid first passes through a first filter 914. A portion of the fluid is directed a fluid line 943 as a pilot or control signal to reset time-delay cylinder 944. I.e.: line 943 becomes pressurized. The purpose of time-delay cylinder 944 will become apparent later. One mode of operation of cylinder 944 will be explained here. The appropriate end of 944 fills, pushing its internal piston or membrane and discharging fluid on the other side and back-flows through orifice 948. The discharging fluid travels through fluid line 942 until reaching and passing through position switch 766 which, at this time, is positioned to indicate "no weight on clamping device 500," so discharging fluid travels to and through fluid line 941 to line 922 and joins other fluid in line 922 (to be explained next) traveling back through valve 910 to the hydraulic reservoir. At the same time, fluid from the pilot port of sequence valve 926 drains through line 942 along with the fluid from time-delay cylinder 944. The integral spring within valve 926 changes valve 926 from the open position to the closed position.

Continuing with pressurized flow line 912, beyond filter 914, the primary flow of fluid divides into two paths, fluid line 912*a* and 912*b*, to supply the cylinder assemblies 805 disposed on opposite sides of key-hole shaped slot 520. From this point forward, only fluid path "a" for one cylinder assembly 805 will be discussed. Fluid path "b" is identical.

Pressurized fluid travels in fluid line 912*a*, reaching the clamping device and its cylinder assembly 805. At this location, the fluid is again divided. Whereas a majority of the fluid continues in line 912 and passes through secondary safety check valve 950*a*. After valve 950, the fluid divides for a final time with a portion going to each of the two cylinder safety check valves 955*a* and finally to the rod-end of a coupled cylinder 810. Pressure in the rod-end causes cylinders 810 to retract, drawing the front and rear clamp bodies 655*a* and 655*b* together. In the operation mode described, check valves 950*a* and 955*a* insure that fluid can travel to the rod-end of cylinders 810 but cannot return.

As cylinders 810 retract, fluid is released from the cap-ends through fluid lines 922*a* and joins fluid line 922*b* when reaching fluid line 922 in the control manifold 905. Fluid passes through a check valve to by-pass sequence valve 926 and passes another check valve to by-pass second fluid filter 924. Fluid then passes through directional control valve 910 and finally back to the fluid reservoir (not shown).

After clamping device 500 has firmly grasped joint 2, operators allow drawworks 320 to transfer the weight of joint 2 and the attached drill string 330 to clamping device 500. At this time and until changed, position switch 766, which acts as a weight indicating sequence valve, is triggered by the weight of the drill string 330 pulling down upper plate 510. Position switch 766 shifts (to the left according the configuration in FIG. 23) and isolates line 941 so no fluid can pass from line 922 to line 941 and through position switch 766. Otherwise, at some situations while clamping device 500 is supporting weight, fluid from line 922 and 941 might otherwise pass through switch 766 and pressurize fluid pilot lines 942 and 946 that lead to the control port of sequence valve 926. Instead, as a result of the isolation of line 941 by switch 766, sequence valve 926 remains in a closed position achieved earlier when line 943 was pressurized. While position switch 766 senses that there is weight on clamping device 500, pilot line 942 is connected to fluid line 958, which can drain to either line 912 or line 922 if and when the pressure in line 958 is greater. Line 958 is protected by check valves so line 958 cannot be pressurized by either line 912 or line 922.

Still referring to FIG. 23, later, when cylinders 810 are to be extended in order to push the two clamp bodies 655*a* and 655*b* apart, pressurized fluid follows nearly an opposite path, but events happen in two stages. In the first stage a pressurized control signal is sent to check valves 950 and 955 to command them to allow reverse flow so that the rod-end of cylinders 810 can be drained. To accomplish this, control valve 910 directs pressurized fluid to line 922 and allows return flow from line 912. Pressurized fluid in line 922 passes through filter 923 and reaches sequence valve 926, which is closed at this time, so the primary flow of fluid cannot yet reach the cap ends of cylinders 810 to expand them. However, a portion of the fluid is directed to a pilot fluid line 941 to act as control signal. Line 941 directs fluid to position switch 766. If clamping device 500 is not holding weight, e.g. the weight of joint 2, as indicated by weight sensor 760 (FIG. 19), then position switch 766 allows fluid from line 941 to enter pilot fluid line 942. Fluid in line 942 takes two paths. Along the first path, fluid in line 942 travels via line 942*a* and 942*b* to the safety control valves 950, 955 located near the two cylinder assemblies on clamping device 500, and releases them to allow reverse flow. As a result, the rod-ends of cylinders 810 are depressurized, but little fluid leaves them because the cap-ends have not yet been pressurized. The pistons of cylinders 810 are stationary during this first stage of operation. Along the second path leaving switch 766, fluid passes through an orifice 948, reducing the flow rate as the fluid enters fluid line 946 and causing a reduction in fluid pressure. The purpose of the fluid in line 946 is to activate sequence valve 926 so it will allow the primary flow of fluid to continue traveling on line 922 to each the cap-ends of cylinders 810. However, a certain pressure in line 946 is required in order to activate sequence valve 926, but fluid in line 946 must first fill time-delay cylinder 944. As cylinder 944 fills, the pressure in line 946 remains lower than the activation pressure of sequence valve 926. When time-delay cylinder 944 becomes full, pressure rises in line 946, eventually reaching the activation pressure required by valve 926. This initiates stage 2 of the cylinder extension sequence. At this time, sequence valve 926 switches and allows fluid to pass through to the other section of line 922 where it divides and travels in line 922*a* and 922*b* to reach the cap-end of the cylinders and to extend cylinder rods 814. Fluid from the cap-ends of cylinder 810 returns through lines 912*a*, 912*b*. This direction of travel is possible because all safety check valves 950 and 955 have been released to allow reverse flow as previously explained. Fluid merges into line 912 and reaches the control panel. Fluid passes through a check valve to by-pass first fluid filter 914 and then returns through directional control valve 910 to reach the fluid reservoir.

General Operation of the Second Embodiment of the Clamping Device

Clamping device 500 has three primary modes or positions within its operational sequence or cycle. These modes are operationally-closed, operationally-open, and removal. The modes will be discussed sequentially. The requisite performance of the drive control system 900 has already been explained. Now, in this section, the purpose of each operational mode and the physical arrangement taken by various components during each mode will be described. The method of transitioning to each mode from the previous mode will be described subsequently.

Operationally-Closed Mode

The operationally-closed mode or position of clamping device 500 is best understood with reference to FIG. 18. In this mode, clamp mechanism 650 radially engages a component of a well string, such as pipe joint 2, which may be a component of drill string 330 in FIG. 1. There would be additional components attached below and possibly above joint 2. The additional components attached below the joint 2 could extend into borehole 334 below clamping device 500. Clamp mechanism 650 is capable of gripping joints and other components with diameters falling within a predefined range of diameters, e.g. 6 to 10 inches in one embodiment. This gripping range is particularly useful in the case of a bottom-hole assembly that may include components with different diameters. The predefined range can encompass all the different diameters present in the bottom-hole assembly. The clamp mechanism 650 would simply be opened further or closed further by the drive mechanism 800 to grip the different parts of the bottom-hole assembly, e.g., during running of a bottom-hole assembly 344 into borehole 334 or retrieval of the bottom-hole assembly 344 from borehole 334. Adjustment of the clamp mechanism 650 does not require replacing or removing any parts of the clamp mechanism 650 for diameters falling within the predefined range. For a new predefined range, parts of the clamp mechanism 650, such as insert carriers 725, can be replaced. After the replacement of parts, the clamp mechanism 650 would grip joints with diameters falling within the new predefined range. As an example, for the described embodiment, the predefined ranges of diameters that can be selected for clamping include 4 to 6 inches, 6 to 10 inches, and 8 to 12 inches; however other ranges are possible. While in the operationally-closed mode, die inserts 722, associated with clamp bodies 655, radially grip the joint 2 that is disposed in the central opening 522. As used herein, the term "radially grip" means to exert force on a well string component by applying force in a radial direction.

Clamping device 500 can hold vertical loads (e.g., the weight of joint 2 and other joints and components attached to joint 2), horizontal forces, and clockwise or counterclockwise torque applied along the axis of joint 2. Thus, clamping device 500 can be used as a back-up tool when making-up or breaking-out connections between joints. When the weight of a joint 2 and well string 330 are applied to clamping device 500, air is relieved from pneumatic bellows 590, causing bellows 590 to compress and upper base plate 510 to settle on to lower base plate 570. This transitioning can be observed with FIGS. 19 and FIG. 20. In the operationally-closed mode, the cylinders 810 remain parallel to the side opening 524 in support structure 505.

The clamping force holding joint 2 is determined by the hydraulic pressure applied to drive mechanism 800 and is independent of the weight of joint 2 and independent the weight of the drill string that may be attached to joint 2. This ability to specify the clamping force independent of the load is provided to allow the system to support well strings of greater weights without crushing the clamped component, e.g. joint 2. This differs from the conventional use of slips where the gripping force on the component is directly related to the weight being supported and where excessive radial force is sometimes applied to the supported component.

Through lower base plate 570, clamping device 500 may be coupled to any suitable structure, e.g., rotary table 338 or rig floor 314 above borehole 334. When clamping device 500 is mounted to a receiving structure by means of lower base plate 570, adapter wings 578, and adapter lugs 508, or similar components, these components (570, 508, and 587) will be able to transfer to the receiving structure the vertical, horizontal, and torque loads concurrently or separately applied to the clamp mechanism 650 by the supported load. The load forces and torque from the supported load will be transferred from the clamp mechanism 650 to drive mechanism 800. The load forces and torque are next transferred to upper base plate 510 through guide strips 550 and T-slots 535 (FIG. 15). The horizontal loads are transferred from the upper base plate 510 to lower base plate 570 through cylindrical protrusions 582 (FIG. 13) and lower guide sleeves 608. Rotation, i.e. torques, are transferred to lower base plate 570 through lower guide sleeves 608. From lower base plate 570, wings 578 and lugs 508 transfer the loads to the receiving structure.

Operationally-Open Mode

The operationally-open mode of clamping device 500 is best described with reference to FIGS. 16 and 17. In this mode, the die inserts 722 have disengaged from the joint 2, which is no longer shown in the central opening 522. Carried by clamp bodies 655, the die inserts 722 have moved away from the center of the central opening 522 to the opening's periphery. Before moving from the operationally-closed mode to the operationally-open mode (from FIG. 18 to FIG. 16), weight must be transferred from clamping device 500 to drawworks 320 (FIG. 1). As a visual indication of this event, pneumatic bellows 590 expand and upper base plate 510 rises to the configuration shown in FIG. 19, indicating to operators that clamping device 500 can be opened. At this point cylinders 810 can be moved to the extended position. Extension of cylinders 810 moves clamp body 655*a* and the clamp body 655*b* away from each other, in a direction parallel to the upper base plate 510 and away from the center of the central opening 522.

As fluid powered cylinders 810 extend, clamp body 655*a* and the clamp body 655*b* are pushed away from one another and therefore away from central opening 522. Because the clamp mechanism 650 and drive mechanism 800 are not rigidly fixed to upper base plate 510, but rather float laterally on upper base plate 510, the pattern of movement of the clamp bodies 655 during retraction is not prescribed until the cylinders 810 reach the outer end stops 547*a*, 547*c* (FIG. 15). That is to say, as fluid powered cylinders 810 extend, clamp body 655*a* may first reach the left side of upper base plate 510, or clamp body 655*b* may first reach the right side of upper base plate 510, or these events could happen simultaneously. Later, when changing to the operationally-closed mode, this lateral "floating," allows clamp mechanism 650 and drive mechanism 800 to self-center on a joint 2 disposed in central opening 522, even if joint 2 is not in the middle of central opening 522. In the operationally-open mode, like the operationally-closed mode, the cylinders 810 remain parallel to the side opening 524 in support structure 505.

Removal Mode

Figure 14:
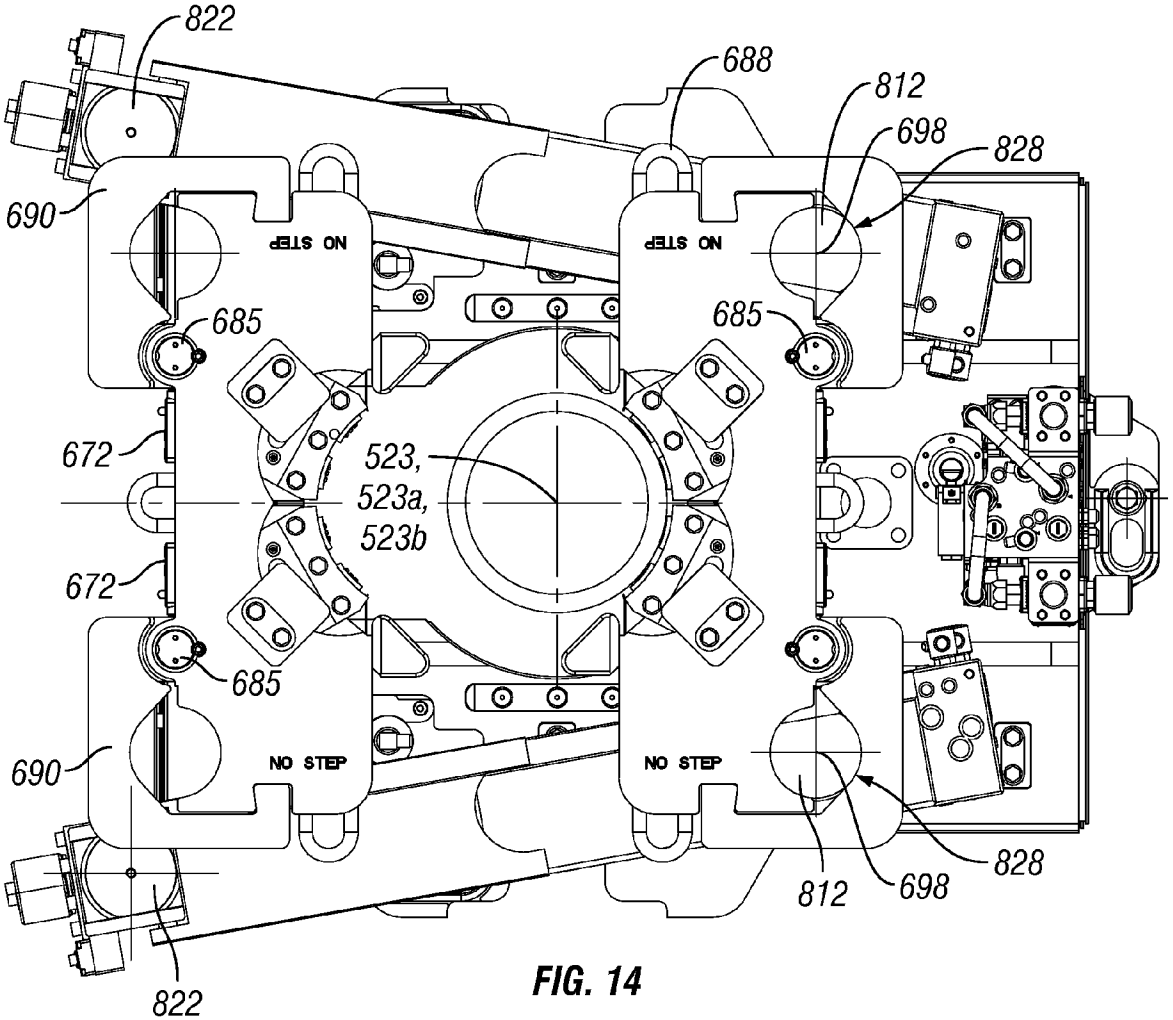
FIG. 14 is a top view of the clamping device of FIG. 10 in stage 1 of the removal mode, in a partially-open position

The removal mode or fully-open position of clamping device 500 is shown in FIGS. 14 and 15. In this mode, cylinder assemblies 805 have been rotated about the pivoting rear joints 828, and clamp body 655*a* has been removed from the remainder of clamping device 500. As a result, side opening 524 of keyhole-shaped slot 520 is unobstructed, and lateral access to the central opening 522 is possible via the side opening 524. While in the removal mode, the entire clamping device 500 can be removed from or placed over borehole 334, whether or not a drill string 330 is already disposed in borehole 334 and possibly extending out from borehole 334. The central opening 522, when aligned with borehole 334, can receive joint 2 of drill string 330 that is disposed in borehole 334 or being run into or removed from the borehole 334. In the removal mode, the cylinders 810 are moved to a position where they are angled, and thus no longer parallel to side opening 524

Clamping device 500 can be moved from the operationally-open mode to the removal mode (from FIG. 16, to FIG. 14, and to FIG. 15). Before changing to the removal mode or position, clamp body 655*b* is locked into position with respect to upper base plate 510. Then, the front clamp body 655*a* must be positioned at the far left side of upper base plate 510 by extending fluid powered cylinders 810. Next, sliding locks 672 on the external face 670 of the front clamp body 655*a* are retracted. Subsequently the two double-L latches 690 on the top of clamp body 655*a* are raised, and the two double-L 690 latches on the bottom of clamp body 655*a* are lowered. Next, clearance is created between the cylindrical studs 822 on pull-blocks 820 and semi-circular grooves 682 on lower and upper arms 680. This clearance is created in two steps. First, now that the bottom two double-L latches have been lowered, cylinders 810 are stroked inward (contracted), causing the bottom two double-L latches to be seated tightly in V-shaped indentations in upper base plate 510. Secondly, the opposite action is performed. Cylinders 810 are stroked in an outward direction (extended). Now, clearance is available, and each cylinder assembly 805 is rotated about the pivoting rear joints 828, away from the front clamp body 655*a*. Front clamp body 655*a* remains in position during the rotation of cylinder assembly 805. When the rotation is accomplished, Front clamp body 655*a* can be removed. To change from the removal mode back to the operationally-open mode (from the position shown in FIG. 15 to the position shown in FIG. 16), the opposite procedure is followed.

To move from the operationally-open mode to the operationally-closed mode (from the position shown in FIG. 16 to the position shown in FIG. 18), cylinders 810 contract and move clamp body 655*a* relative to clamp body 655*b*. In this manner, clamp bodies 655*a*, 655*b* move towards central opening 522 and towards a component of well string 330, for example a drill pipe joint 2. As clamp bodies 655*a*, 655*b* move, joint alignment wedges 740 push joint 2 towards the center 523 of central opening 522 if joint 2 is closer to one long outer edge 516 or the other. Fitted in the pivotable gripping devices 720, the positions of the die inserts 722 are self-adjustable to accommodate a large-diameter well string component or a small-diameter component within a pre-defined range of diameters. As clamp bodies 655 move parallel to the upper base plate 510, continue toward the center of the central opening 522, and begin to contact a joint 2, the positions of the die inserts 722 adjust to match the diameter of the joint to be gripped. This adjustment is facilitated by the multiplicity of curved surfaces associated with pivotable gripping devices 720, as previously described. The fluid powered cylinders 810 apply clamping force to the clamp bodies 655 when engaging a joint.

Clamping device 500 may be used in conjunction with well operation system 300 during any or during several stage(s) of operation. For example, it may be used during investigative probing, during initial drilling, during continuation drilling after casing and cement have been added to some or all of a borehole, and/or during production. Consequently, clamping device 500 may be used with exploratory wells, production wells, or other well-related operations. Further, although clamping devices 1 and 500 have been described with reference to a well used for the exploration and ultimate recovery of oil and gas, the clamping device 1 and 500 and methods of their use may be employed in water wells, geothermal wells and in any application where a borehole is formed in the earth.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, operating pressures and other parameters can be varied. As another example, hydraulic power and controls are primarily discussed, but other hydraulic, pneumatic, and/or electrical arrangements are possible and fit within this disclosure. Accordingly, the scope of protection is not limited to the embodiments described herein, but is only limited by the claims that follow, the scope of which shall include all equivalents of the subject matter of the claims.

The invention claimed is:

1. An apparatus for suspending a well string along a generally vertical axis, comprising:

a base plate having a slotted opening for receiving a component of the well string that is disposed generally along the axis;

a clamp mechanism supported from the base plate comprising a first clamp body supported for linear motion relative to the base plate and positioned on a first side of the axis, and a second clamp body supported for linear motion relative to the base plate and positioned on a second side of the axis, the first and second clamp bodies including gripping surfaces for engaging the well string component received in the opening; and a drive mechanism coupled to the clamp bodies and configured to move the clamp bodies toward the axis and to bring the gripping surfaces into engagement with the well string component:

wherein at least one of the clamp bodies comprises:

at least one receiving recess having a concave surface;

a carrier member disposed in the receiving recess and having a convex surface facing the concave surface of the receiving recess, and having at least one receiving recess having a concave surface;

an insert member disposed in the carrier member and having a convex surface facing the concave surface of the carrier member, and having a gripping surface for gripping the well string component.

2. The apparatus of claim 1 wherein the clamp mechanism is configured to support the weight of the entire well string when, in a first mode of operation, the clamp bodies are positioned to engage the well string.

3. The apparatus of claim 2, further comprising an adapter coupled to the base plate, the adapter being configured for coupling the base plate to an external structure and transferring the weight of the well string from the clamp mechanism to the external structure.

4. The apparatus of claim 1 wherein the opening has a key hole shape.

5. The apparatus of claim 1 wherein the opening includes a generally circular opening and a side opening that is contiguous with the generally circular opening and that extends to the edge of the base plate, and wherein one of the clamp bodies blocks access to the generally circular opening via the side opening in at least a first mode of operation.

6. The apparatus of claim 5 wherein the clamp body that blocks access to the opening in the first mode of operation is, in a second mode of operation, repositionable to a position allowing a well string component to be passed through the side opening and into the generally circular opening.

7. The apparatus of claim 5 wherein the drive mechanism comprises at least a pair of cylinder assemblies, each of said pair having a first end pivotably connected to the base plate, and a second end configured to releasably engage the clamp body that blocks the opening in the first mode of operation.

8. The apparatus of claim 7 wherein said cylinders are configured such that the second ends of the cylinders swing away from the opening in the base plate in at least the first mode of operation.

9. The apparatus of claim 1, wherein the drive mechanism is configured to impart the linear motions simultaneously to the first and second clamp bodies in at least a first mode of operation.

10. The apparatus of claim 1 wherein the clamp bodies include gripping members that are self adjusting to the size of the well string component.

11. An apparatus for suspending a well string along a generally vertical axis, comprising:

a base plate having a slotted opening for receiving a component of the well string that is disposed generally along the axis;

a clamp mechanism supported from the base plate comprising a first clamp body supported for linear motion relative to the base plate and positioned on a first side of the axis, and a second clamp body supported for linear motion relative to the base plate and positioned on a second side of the axis, the first and second clamp bodies including gripping surfaces for engaging the well string component received in the opening; and a drive mechanism coupled to the clamp bodies and configured to move the clamp bodies toward the axis and to bring the gripping surfaces into engagement with the well string component;

wherein said base plate comprises an upper and a lower plate and a plurality of bellows disposed between the upper and lower plates and configured to expand in a mode where the clamping mechanism is not supporting the weight of the well string and to contract in a mode where the clamping mechanism is supporting the weight of the well string.

12. The apparatus of claim 11 wherein the opening includes a generally circular opening and a side opening that is contiguous with the generally circular opening and that extends to the edge of the base plate, and wherein one of the clamp bodies blocks access to the generally circular opening via the side opening in at least a first mode of operation.

13. The apparatus of claim 12 wherein the clamp body that blocks access to the opening in the first mode of operation is, in a second mode of operation, repositionable to a position allowing a well string component to be passed through the side opening and into the generally circular opening.

14. The apparatus of claim 12 wherein the drive mechanism comprises at least a pair of cylinder assemblies, each of said pair having a first end pivotably connected to the base plate, and a second end configured to releasably engage the clamp body that blocks the opening in the first mode of operation.

15. The apparatus of claim 14 wherein said cylinders are configured such that the second ends of the cylinders swing away from the opening in the base plate in at least the first mode of operation.

16. The apparatus of claim 11, wherein the drive mechanism is configured to impart the linear motions simultaneously to the first and second clamp bodies in at least a first mode of operation.

17. The apparatus of claim 11 wherein the clamp mechanism is configured to support the weight of the entire well string when, in a first mode of operation, the clamp bodies are positioned to engage the well string.

18. The apparatus of claim 17, further comprising an adapter coupled to the base plate, the adapter being configured for coupling the base plate to an external structure and transferring the weight of the well string from the clamp mechanism to the external structure.

19. The apparatus of claim 11 wherein the clamp bodies include gripping members that are self adjusting to the size of the well string component.

20. An apparatus for suspending a well string along a generally vertical axis, comprising:

a base plate having a slotted opening for receiving a component of the well string that is disposed generally along the axis;

a clamp mechanism supported from the base plate comprising a plurality of clamp bodies supported for linear motion relative to the base plate and positioned about the opening, the clamp bodies including gripping surfaces for engaging the well string component received in the opening; and a drive mechanism coupled to the clamp bodies and configured to move the clamp bodies toward the axis and to bring the gripping surfaces into engagement with the well string component;

wherein at least one of the clamp bodies is adapted to move between a first position in which the movable clamp body blocks the opening from receiving a well string component and a second position in which the movable clamp body does not block the opening; and wherein the drive mechanism comprises at least a pair of cylinder assemblies, each of said pair having a first end pivotably connected to the base plate, and a second end configured to releasably engage a clamp body that blocks the opening in the first mode of operation.

21. The apparatus of claim 20 wherein the clamp mechanism is configured to support the weight of the entire well string when, in a first mode of operation, the clamp bodies are positioned to engage the well string.

22. The apparatus of claim 20 wherein said cylinders are configured such that the second ends of the cylinders swing away from the opening in at least the first mode of operation.

23. The apparatus of claim 20 wherein the clamp bodies include gripping members that are self adjusting to the size of the well string component.

24. The apparatus of claim 20 wherein at least one of the clamp bodies comprises:

at least one receiving recess having a concave surface;

a carrier member disposed in the receiving recess and having a convex surface facing the concave surface of the receiving recess, and having at least one receiving recess having a concave surface;

an insert member disposed in the carrier member and having a convex surface facing the concave surface of the carrier member, and having a gripping surface for gripping the well string component.

25. The apparatus of claim 20 further comprising a plurality of bellows coupled to the base plate and configured to provide a visual indication of the mode of operation, the bellows expanding in a mode where the clamping mechanism is not supporting the weight of the well string, and contracting in a mode where the clamping mechanism is supporting the weight of the well string.

26. The apparatus of claim 20 wherein the movable clamp body spans across the opening while in the first position; and wherein the gripping surfaces are configured to engage and to disengage, selectively, a previously-received well string component while the movable clamp body is in the first position.

27. An apparatus for suspending a well string along a generally vertical axis, comprising:

a base plate having a slotted opening for receiving a component of the well string that is disposed generally along the axis;

a clamp mechanism supported from the base plate comprising a plurality of clamp bodies supported for linear motion relative to the base plate and positioned about the opening, the clamp bodies including gripping surfaces for engaging the well string component received in the opening;

a drive mechanism coupled to the clamp bodies and configured to move the clamp bodies toward the axis and to bring the gripping surfaces into engagement with the well string component; and an adapter coupled to the base plate, the adapter being configured for coupling the base plate to an external structure and transferring the weight of the well string from the clamp mechanism to the external structures;

wherein at least one of the clamp bodies is adapted to move between a first position in which the movable clamp body blocks the opening from receiving a well string component and a second position in which the movable clamp body does not block the opening.

28. The apparatus of claim 27 wherein said cylinders are configured such that the second ends of the cylinders swing away from the opening in at least the first mode of operation.

29. The apparatus of claim 27 wherein the clamp bodies include gripping members that are self adjusting to the size of the well string component.

30. The apparatus of claim 27 wherein at least one of the clamp bodies comprises:

at least one receiving recess having a concave surface;

a carrier member disposed in the receiving recess and having a convex surface facing the concave surface of the receiving recess, and having at least one receiving recess having a concave surface;

an insert member disposed in the carrier member and having a convex surface facing the concave surface of the carrier member, and having a gripping surface for gripping the well string component.

31. The apparatus of claim 27 further comprising a plurality of bellows coupled to the base plate and configured to provide a visual indication of the mode of operation, the bellows expanding in a mode where the clamping mechanism is not supporting the weight of the well string, and contracting in a mode where the clamping mechanism is supporting the weight of the well string.

32. The apparatus of claim 27 wherein the movable clamp body spans across the opening while in the first position; and wherein the clamp bodies are configured to engage and to disengage, selectively, the gripping surfaces and a previously-received well string component while the movable clamp body is in the first position.

* * * * *